US011339032B2

(12) United States Patent
Fisher et al.

(10) Patent No.: US 11,339,032 B2
(45) **Date of Patent: *May 24, 2022**

(54) STRUCTURE INSTALLATION SYSTEM WITH VEHICLE HAVING HANGERS TO SUPPORT A WALL

(71) Applicant: TGR Construction, Inc., Tempe, AZ (US)

(72) Inventors: Thomas G. Fisher, Dickinson, ND (US); Gregory L. Schafer, Dickinson, ND (US)

(73) Assignee: TGR Construction, Inc., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/876,695

(22) Filed: May 18, 2020

(65) Prior Publication Data

US 2020/0277166 A1 Sep. 3, 2020

Related U.S. Application Data

(63) Continuation of application No. 16/588,375, filed on Sep. 30, 2019, now Pat. No. 10,654,689, which is a (Continued)

(51) Int. Cl.
*B66C 1/24* (2006.01)
*B66C 23/40* (2006.01)

(Continued)

(52) U.S. Cl.
CPC ..... *B66C 1/24* (2013.01); *B66C 23/36* (2013.01); *B66C 2700/0357* (2013.01); *E04H 17/1417* (2013.01)

(58) Field of Classification Search
CPC ..... B66C 23/36; B66C 23/40; B66C 1/24; B66C 2700/0357; E04H 17/1417;

(Continued)

(56) References Cited

U.S. PATENT DOCUMENTS 1,629,899 A 5/1927 Wustholz
1,721,816 A 7/1929 Glazer (Continued)

FOREIGN PATENT DOCUMENTS

CA 2923047 A1 * 9/2017 ..... B60B 30/02
DE 2657111 A1 6/1977

(Continued)

OTHER PUBLICATIONS http://www.aluminumconcreteforms.com/crane_set_concrete_forms.htm; Wall-Ties & Forms Concrete Big Panel Concrete Forms Website Page.

(Continued)

*Primary Examiner* — Michael Safavi
(74) *Attorney, Agent, or Firm* — Neustel Law Offices

(57) ABSTRACT

A structure installation system which maintains one or more walls in a desired position and orientation during installation of the one or more walls. The structure installation system generally includes a vehicle which is adapted to traverse a ground surface. The vehicle includes an arm having an arm coupler to which a support is connected. One or more walls adapted to be installed in the ground surface may be removably connected to the support, such as by securing the walls to adjustable hangers that are removably connected to the support. By adjusting the positioning of the hangers, the orientation and position of the walls may be adjusted. Once put in position, the vehicle and support will retain the walls in the desired position and orientation while concrete is poured and allowed to cure to form a unitary structure such as a bollard wall.

54 Claims, 17 Drawing Sheets

Related U.S. Application Data continuation of application No. 16/152,641, filed on Oct. 5, 2018, now Pat. No. 10,427,916.

(51) Int. Cl.
*B66C 23/36* (2006.01)
*E04H 17/14* (2006.01)

(58) Field of Classification Search
CPC ..... E04G 19/00; E04G 19/003; E04G 11/08; E04G 11/20; B66F 9/18
USPC ..... 264/33
See application file for complete search history.

(56) References Cited

U.S. PATENT DOCUMENTS 1,925,689 A 9/1933 Dietrich
2,049,916 A 8/1936 Lingle
2,164,592 A 7/1939 Pilj
2,172,461 A 9/1939 Whitescarver
2,173,698 A 9/1939 Schenk
2,395,204 A 2/1946 Symons
2,497,887 A 2/1950 Hilpert
2,614,801 A 10/1952 Mazzei
2,659,125 A 11/1953 Chester
2,717,801 A 9/1955 Neil
3,163,904 A 1/1965 Ziolkowski
3,464,667 A 9/1969 Sledz
3,478,396 A 11/1969 Drouillard
3,635,613 A 1/1972 Marsh
3,647,099 A * 3/1972 Carriere ..... B66F 9/065 414/634
3,676,031 A 7/1972 Stinton
3,687,597 A 8/1972 Lavergne
3,693,931 A 9/1972 Holt
3,801,061 A 4/1974 Holt
3,833,706 A 9/1974 Edwards
3,844,697 A 10/1974 Edwards
3,910,546 A 10/1975 Connors
3,926,318 A 12/1975 Kister
3,954,189 A 5/1976 Sherritt
3,965,542 A 6/1976 Gregory
4,003,543 A 1/1977 Doubleday
4,006,878 A 2/1977 Dawson
4,023,771 A 5/1977 Walchek
4,044,986 A 8/1977 Strickland
4,098,045 A 7/1978 Astor
4,158,452 A 6/1979 Gates
4,186,906 A 2/1980 Koga
4,192,481 A 3/1980 Durbin
4,218,039 A 8/1980 Gates
4,221,357 A 9/1980 Bowden
4,231,541 A 11/1980 Strickland
4,254,932 A 3/1981 Durbin
4,290,246 A 9/1981 Hilsey
4,314,775 A 2/1982 Johnson
4,405,262 A 9/1983 Nagashima
4,417,425 A 11/1983 Case
4,441,685 A 4/1984 Greeson
4,453,861 A * 6/1984 Bretz ..... E02D 5/18 405/267
4,481,743 A 11/1984 Jellen
4,526,278 A * 7/1985 Hebert ..... E02F 3/963 212/242
4,611,784 A 9/1986 Gallis
4,671,724 A 6/1987 Bolton
4,676,713 A * 6/1987 Voelpel ..... B65G 49/061 414/590
4,700,979 A 10/1987 Courtois
4,708,315 A 11/1987 Carlson
4,726,562 A 2/1988 Courtois
4,795,136 A 1/1989 Haefner
4,807,843 A 2/1989 Courtois
4,812,113 A 3/1989 Jantzen
4,846,433 A 7/1989 Courtois
4,899,978 A 2/1990 Gates
4,924,641 A 5/1990 Gibbar, Jr.
4,927,317 A 5/1990 Acosta
5,038,541 A 8/1991 Gibbar, Jr.
5,050,365 A 9/1991 Edgar
5,073,077 A 12/1991 Attman
RE33,881 E 4/1992 Courtois
5,114,294 A 5/1992 Attman
5,127,791 A * 7/1992 Attman ..... B66F 9/0655 414/10
5,224,808 A 7/1993 Macris
5,351,456 A 10/1994 Paine, Jr.
5,364,050 A 11/1994 Smith
5,425,213 A 6/1995 Abe
5,441,379 A 8/1995 Gilbert, Jr.
5,537,797 A 7/1996 Harkenrider
5,584,646 A * 12/1996 Lewis ..... B66C 1/68 180/211
5,624,222 A 4/1997 Hiatt
5,643,488 A 7/1997 Lee
5,799,399 A 9/1998 Schultz
5,857,296 A 1/1999 Niday
5,922,236 A 7/1999 Zuhl
5,956,922 A 9/1999 Liuska
6,513,785 B1 2/2003 Worley
6,523,323 B2 2/2003 Worley
6,729,079 B2 5/2004 Francies, III
6,755,385 B2 6/2004 Lancelot, III
6,935,607 B2 8/2005 Ward
7,004,443 B2 2/2006 Bennett
7,051,988 B2 5/2006 Shaw
7,144,186 B1 12/2006 Nolte
7,222,460 B2 5/2007 Francies, III
7,775,500 B1 8/2010 Vegsund
7,819,388 B2 10/2010 McCallion
7,828,263 B2 11/2010 Bennett
7,874,053 B2 1/2011 Stangel
8,186,645 B2 5/2012 Shaw
8,272,824 B1 * 9/2012 Putney ..... A01G 23/02 414/23
8,317,502 B1 11/2012 Grey
8,464,996 B2 6/2013 Spindler
9,033,619 B2 5/2015 Riggle, Jr.
9,212,462 B2 12/2015 Borel
9,297,179 B2 3/2016 Smith
9,347,231 B2 5/2016 Cormier
9,988,823 B1 6/2018 Fisher
10,662,046 B1 * 5/2020 Engebretson ..... B66F 11/046
2003/0057747 A1 3/2003 Johnston
2004/0218997 A1 11/2004 Neubauer
2005/0218291 A1 10/2005 Musk
2005/0220597 A1 10/2005 Burkett
2006/0062655 A1 3/2006 Harrelson
2006/0242921 A1 11/2006 Massie
2008/0050213 A1 2/2008 Kundel
2009/0057518 A1 3/2009 Russell
2009/0107065 A1 4/2009 LeBlang
2009/0267320 A1 10/2009 Phillips
2011/0011018 A1 1/2011 Johnson
2011/0033232 A1 2/2011 Adler
2011/0057090 A1 3/2011 Spude
2011/0305529 A1 * 12/2011 Riggle, Jr. ..... E02D 17/083 405/283
2012/0131870 A1 5/2012 deMaere
2013/0020732 A1 1/2013 Jentsch
2013/0248680 A1 9/2013 Fergeson
2013/0269284 A1 * 10/2013 Hovenier ..... E04G 21/167 52/745.11
2014/0263942 A1 9/2014 Ciuperca
2015/0052839 A1 2/2015 Rice
2015/0081178 A1 3/2015 Billaud
2016/0161047 A1 * 6/2016 Kaytes ..... G09F 7/18 248/122.1
2016/0201408 A1 7/2016 Little
2017/0218614 A1 8/2017 Ciuperca
2018/0029851 A1 * 2/2018 Polumati ..... B66C 13/54
2018/0071949 A1 3/2018 Giles

(56) References Cited

U.S. PATENT DOCUMENTS

| | | | |
|---|---|---|---|
| 2018/0112389 | A1 | 4/2018 | Lake |
| 2018/0347213 | A1 | 12/2018 | Clevenger |
| 2018/0347227 | A1 | 12/2018 | Neusch |

FOREIGN PATENT DOCUMENTS

| | | | | | |
|---|---|---|---|---|---|
| DE | 102012206353 | A1 | | 10/2013 | |
| EP | 2308790 | A1 | * | 4/2011 | ..... E04G 19/003 |
| EP | 3179010 | A1 | | 6/2017 | |
| FR | 2951149 | B1 | | 4/2011 | |
| FR | 2973360 | A1 | * | 10/2012 | ..... B66F 9/181 |
| FR | 3032953 | B1 | | 8/2016 | |
| FR | 3045692 | A1 | | 6/2017 | |
| JP | 08260705 | A | | 2/2005 | |
| JP | 2015007337 | A | | 1/2015 | |
| SU | 903530 | A1 | | 2/1982 | |

OTHER PUBLICATIONS http://www.aluminumconcreteforms.com/concrete_forming_systems.htm; Wall-Ties & Forms Concrete Forming Systems and Formwork Website Page.

http://www.daytonsuperior.com/search#?sections=products&productlines=forming; Dayton Product Search Website Page.

Dayton Forming Accessories Handbook.

Dayton Rapid Clamp System Manual.

Dayton Steel Ply System Manual.

Harsco LOGIK Forming System Manual.

PCT International Search Report and Written Opinion for PCT/US2018/20499.

PCT International Search Report and Written Opinion for PCT application PCT/US2018/062473.

MeadowBurke Sure-Lock Strand Chucks Publication; Oct. 2008.

https://www.nogalesinternational.com/news/bollard-border-fence-draws-good-reviews-on-first-anniversary/article_3c0e21c6-e884-11e1-aedc-001a4bcf887a.html; Aug. 17, 2012.

https://www.nationalreview.com/the-morning-jolt/trumps-great-wall-isnt-whats-being-built/; National Review Website Article Trumps Great Wall Isn't What's Being Built; Dec. 12, 2018.

https://www.businessinsider.com/trump-border-wall-construction-photos-new-mexico-2018-4;Trump Administration Releases New Photos of Border Wall Article; Apr. 11, 2018.

http://theminiaturespage.com/boards/msg.mv?id=452833; The Miniatures Page Message Board Bollard Wall Thread; May 5, 2017.

* cited by examiner

STRUCTURE INSTALLATION SYSTEM WITH VEHICLE HAVING HANGERS TO SUPPORT A WALL

CROSS REFERENCE TO RELATED APPLICATIONS

The present application is a continuation of U.S. application Ser. No. 16/588,375 filed on Sep. 30, 2019 which issues as U.S. Pat. No. 10,654,689 on May 19, 2020, which is a continuation of U.S. application Ser. No. 16/152,641 filed on Oct. 5, 2018 now issued as U.S. Pat. No. 10,427,916. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a structure installation system which maintains one or more walls in a desired position and orientation during installation of the one or more walls.

Related Art

Any discussion of the related art throughout the specification should in no way be considered as an admission that such related art is widely known or forms part of common general knowledge in the field.

Structures such as walls are installed using a wide range of methods. One common method of wall installation involves bracing the wall with its lower end within a concrete fill area such as a trough dug into the ground surface. The wall is braced and supported by a wide range of different devices which often require a complicated set-up and removal process. It can be a complicated process to position the walls in a desired position and orientation prior to pouring and setting concrete.

It is also often different to orient and position the walls in a desired position and orientation during the process of pouring concrete and allowing the concrete to cure. Even when braced, the walls may shift. Further, bracing may be difficult and prone to error when installing such walls in uneven terrain or on a slope. In the past, such walls have been manually positioned and oriented, and then braced in position by supports such as posts or poles that are anchored to the ground surface and susceptible disruption (such as if bumped into).

SUMMARY

An example embodiment is directed to a structure installation system. The structure installation system includes a vehicle which is adapted to traverse a ground surface. The vehicle includes an arm having an arm coupler to which a support is connected. One or more walls adapted to be installed in the ground surface may be removably connected to the support, such as by securing the walls to adjustable hangers that are removably connected to the support. By adjusting the positioning of the hangers, the orientation and position of the walls may be adjusted. Once put in position, the vehicle and support will retain the walls in the desired position and orientation while concrete is poured and allowed to cure to form a unitary structure such as a bollard wall.

There has thus been outlined, rather broadly, some of the embodiments of the structure installation system in order that the detailed description thereof may be better understood, and in order that the present contribution to the art may be better appreciated. There are additional embodiments of the structure installation system that will be described hereinafter and that will form the subject matter of the claims appended hereto. In this respect, before explaining at least one embodiment of the structure installation system in detail, it is to be understood that the structure installation system is not limited in its application to the details of construction or to the arrangements of the components set forth in the following description or illustrated in the drawings. The structure installation system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
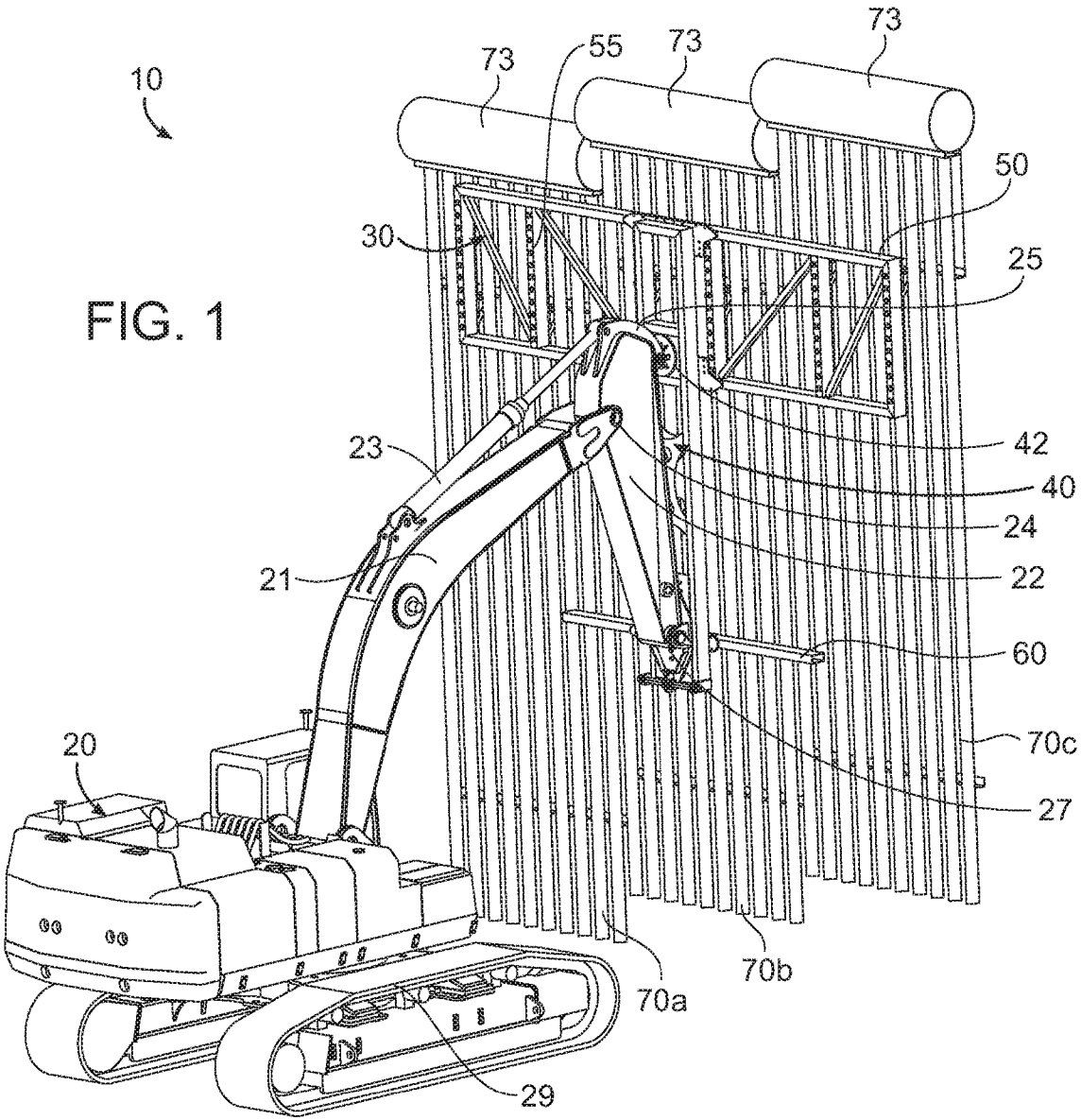
FIG. 1 is a perspective view of a structure installation system in accordance with an example embodiment.
Figure 3:
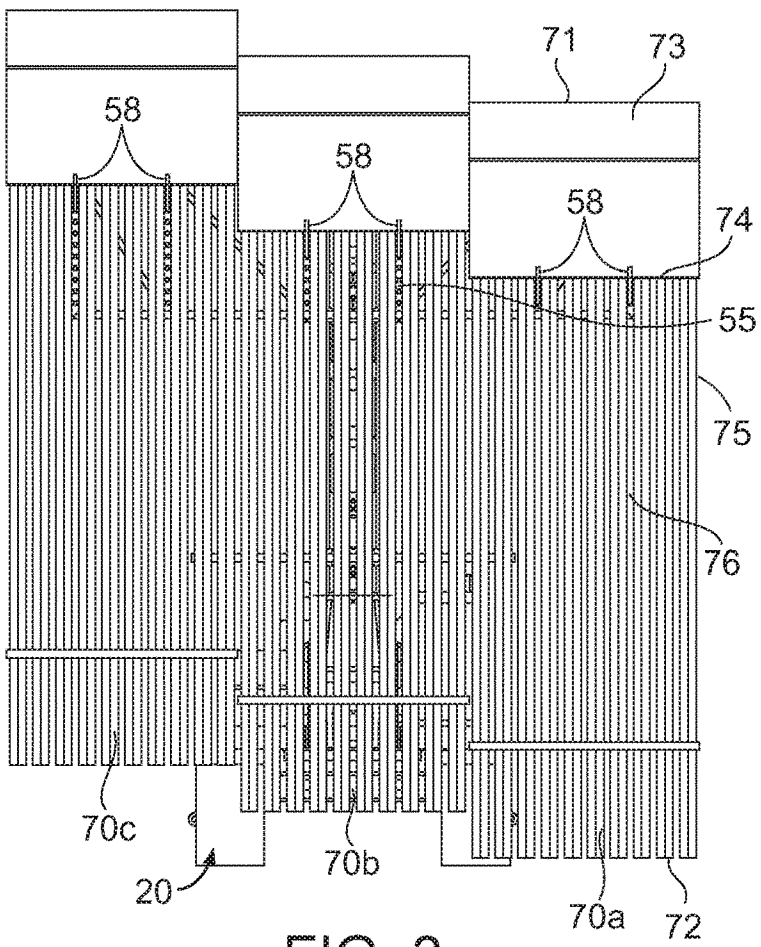
FIG. 3 is a frontal view of a structure installation system in accordance with an example embodiment.

A. Overview.

An example structure installation system 10 generally comprises a vehicle 20 adapted to traverse a ground surface 12. The vehicle 20 may include an arm 21 extending from the vehicle 20, an arm coupler 22 connected to the arm 21, and a plurality of wheels or a plurality of tracks 29 connected to a motor. A wall 70 adapted to be installed in the ground surface 12 may be supported by a support 30 connected to the arm 21 of the vehicle 20. The support 30 may be connected to the arm coupler 22 so as to be rotatable with respect to the arm 21 of the vehicle 20. The support 30 comprises an upper end 31 and a lower end 32.

The support 30 may be rotatable about a roll axis with respect to the arm 21. The support 30 may in some embodiments comprise a hanger frame 50; the hanger frame 50 comprising a plurality of hanger supports 55. Each of the plurality of hangers 58 may be removably connected to one of the hanger supports 55 of the hanger frame 50. Each of the hanger supports 55 of the hanger frame 50 may comprise a plurality of hanger receivers 56; with each of the hanger receivers 56 comprising an opening adapted to removably receive one of the plurality of hangers 58.

The support 30 may comprise a brace 60 adapted to rest against the wall 70. The hanger frame 50 may be connected to the upper end 31 of the support 30 and the brace 60 may be connected to the lower end 32 of the support 30. The support 30 may comprise a coupler 40; with the coupler 40 of the support 30 being removably connected to the arm coupler 22 of the arm 21 of the vehicle 20. The coupler 40 may comprise a first connector 42 and a second connector 46; with the first connector 42 and the second connector 46 each being pivotably connected to the arm coupler 22 of the arm 21 of the vehicle 20.

A plurality of hangers 58 may be connected to the support 30; with the wall 70 being removably connected to the hangers 58. The support 30 is adapted to retain the wall 70 in a desired position and orientation with respect to the ground surface 12 during installation of the wall 70 in the ground surface 12. The hangers 58 may be removably connected to the support 30. The wall 70 may comprise a bollard wall including a plurality of vertical beams 75 defining a plurality of slots 76. Each of the plurality of hangers 58 may be connected within one of the slots 76 of the wall 70.

Another example structure installation system 10 may utilize a plurality of walls 70*a*, 70*b*, 70*c*. Such an embodiment may comprise a vehicle 20 adapted to traverse a ground surface 12; the vehicle 20 including an arm 21 extending from the vehicle 20, an arm coupler 22 connected to the arm 21, and a plurality of wheels or a plurality of tracks 29 connected to a motor. A plurality of walls 70 may be adapted to be installed in the ground surface 12 to form a structure 16.

A support 30 may be connected to the arm 21 of the vehicle 20, such as by being connected to the arm coupler 22. The support 30 may be rotatable about a roll axis and a pitch axis with respect to the arm 21 of the vehicle 20. A hanger frame 50 may be connected to the support 30; with the hanger frame 50 comprising a plurality of hanger receivers 56. A plurality of hangers 58 may be removably connected to the hanger receivers 56 of the hanger frame 50; with the walls 70 being removably connected to the hangers 58. The support 30 may be adapted to retain each of the walls 70 in a desired position and orientation with respect to the ground surface 12 during installation of the walls 70 in the ground surface 12.

The plurality of walls 70 may comprise a first wall 70*a* and a second wall 70*b*. The first wall 70*a* may be connected to the plurality of hangers 58 at a first height and the second wall 70*b* may be connected to the plurality of hangers 58 at a second height; with the first height being lower than the second height. Each of the walls 70 may comprise a bollard wall including a plurality of slots 76; with each of the plurality of hangers 58 being connected within one of the plurality of slots 76.

The support 30 may comprise a coupler 40; with the coupler 40 of the support 30 being removably connected to the arm coupler 22 of the arm 21 of the vehicle 20. The coupler 40 may be pivotably connected to the arm coupler 22 such that the support 30 is rotatable about the roll axis with respect to the arm 21.

B. Vehicles.

As shown throughout the figures, vehicles 20 may be utilized to support, move, adjust, and retain one or more walls 70 in position while they are set in concrete 14 utilizing the methods and systems described herein. While the figures illustrate the vehicles 20 as comprising excavators, it should be appreciated that a wide range of vehicles 20 may be utilized, such as trucks, cars, loaders, and the like.

As best shown in FIG. 1, each vehicle 20 may include an arm 21 which is movably connected to the vehicle 20. The arm 21 is generally controlled from within the cab of the vehicle 20, though external or remote controls may be utilized in some embodiments. The arm 21 may include an arm coupler 22 at its distal end which is utilized to interconnect the arm 21 with a support 30 utilized to support the wall section(s) 70 in a desired position and orientation during installation of the structure 16.

Figure 8:
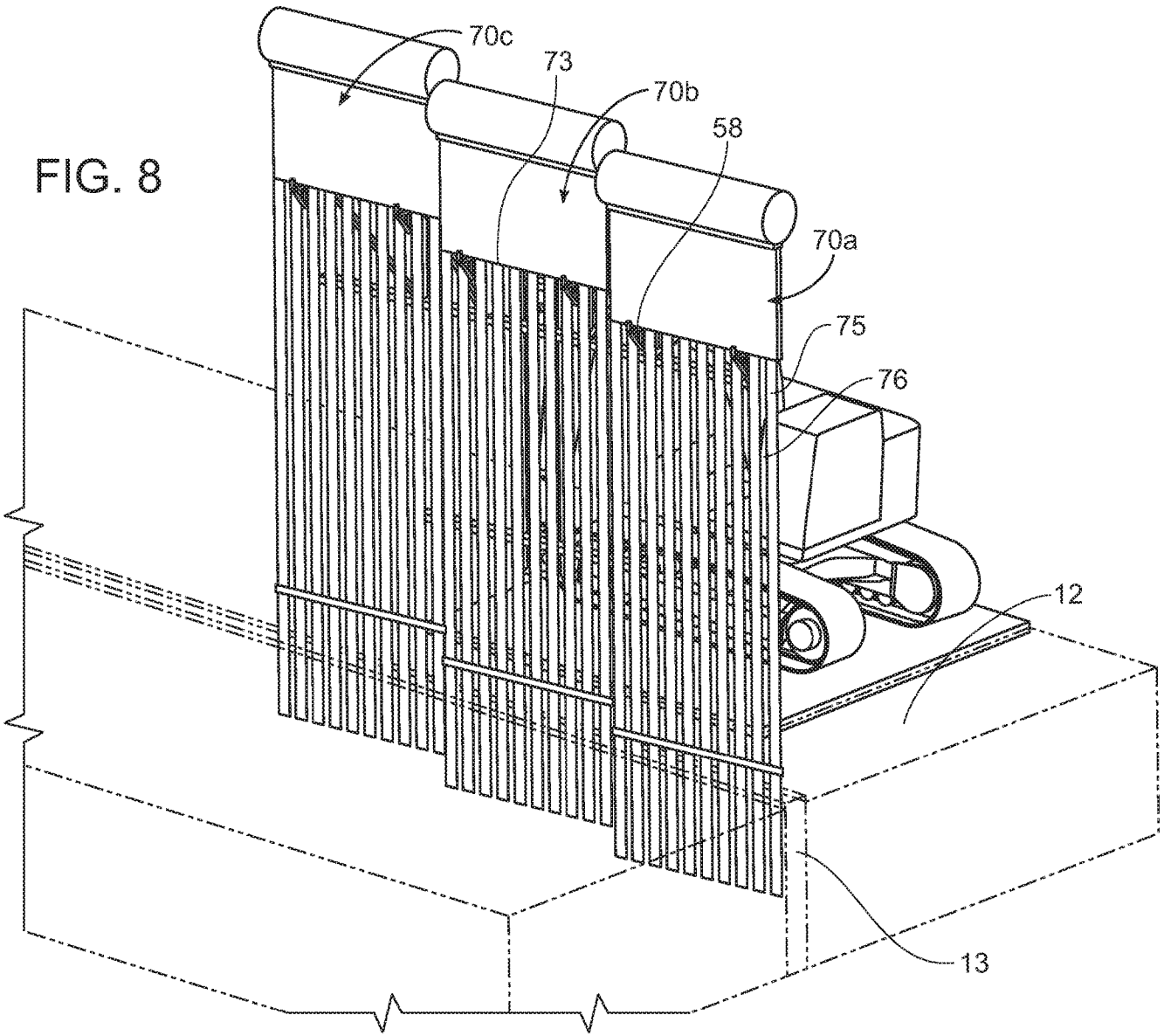
FIG. 8 is a front perspective view of a structure installation system with walls being retained in a desired position and orientation in accordance with an example embodiment.
Figure 9:
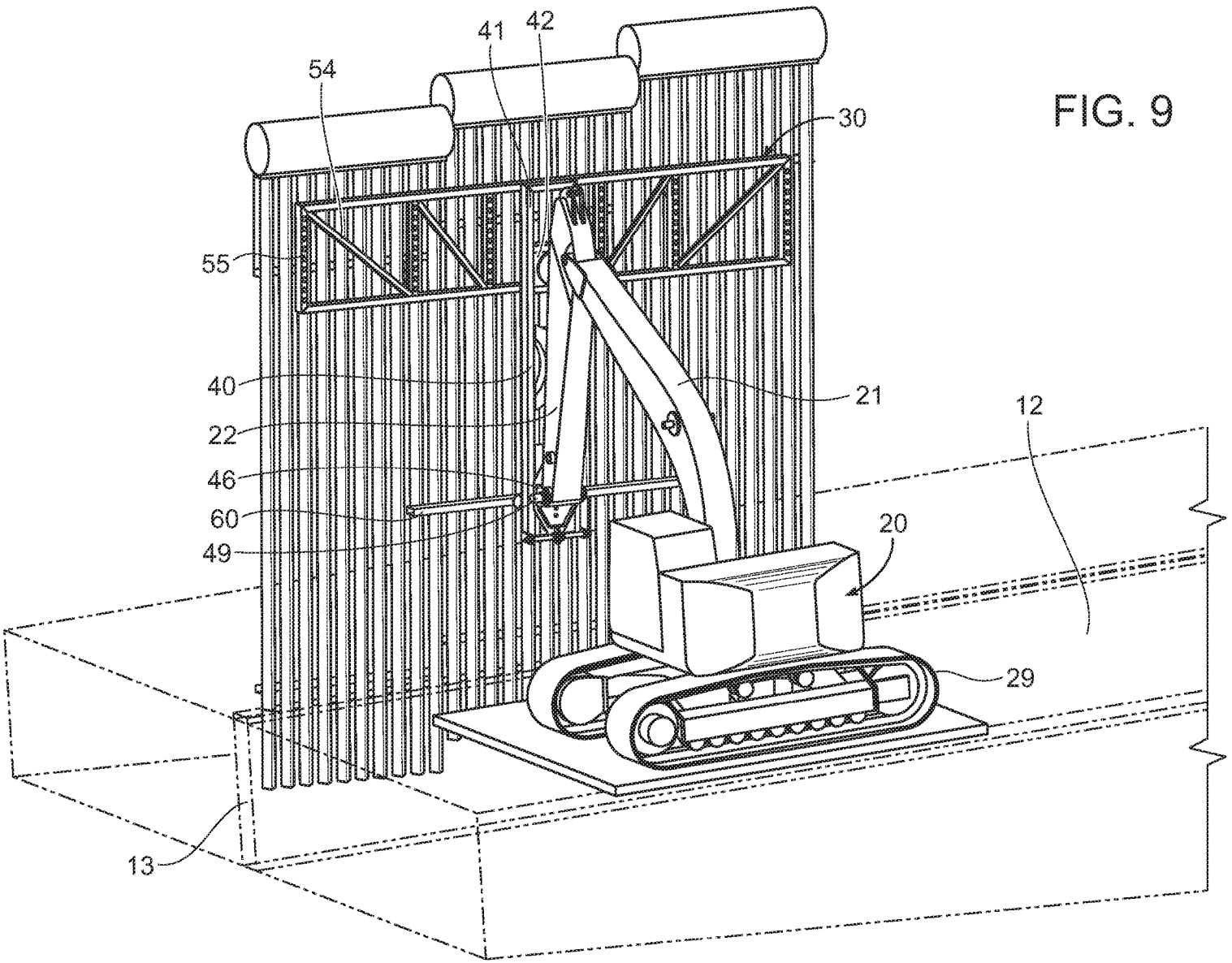
FIG. 9 is a rear perspective view of a structure installation system with walls being retained in a desired position and orientation in accordance with an example embodiment.

As best shown in FIGS. 8-9, each vehicle 20 may traverse the ground surface 12 using a plurality of tracks 29. Although not shown, it should be appreciated that the vehicle 20 may instead use wheels or any other device known to permit a vehicle 20 to traverse a ground surface 17. In some embodiments, the vehicles 20 may be on rails or the like which run alongside the structure 16 being built.

The arm coupler 22 may be rotatably (hingedly) connected to the arm 21 via a hinge 24 as shown in FIGS. 1-4. In the figures, the arm coupler 22 is illustrated as being adapted to rotate about a pitch axis. It should be appreciated, however, that in alternate embodiments the arm coupler 22 may be adapted to rotate about one or more axes, including pitch, roll, and/or yaw.

Figure 2:
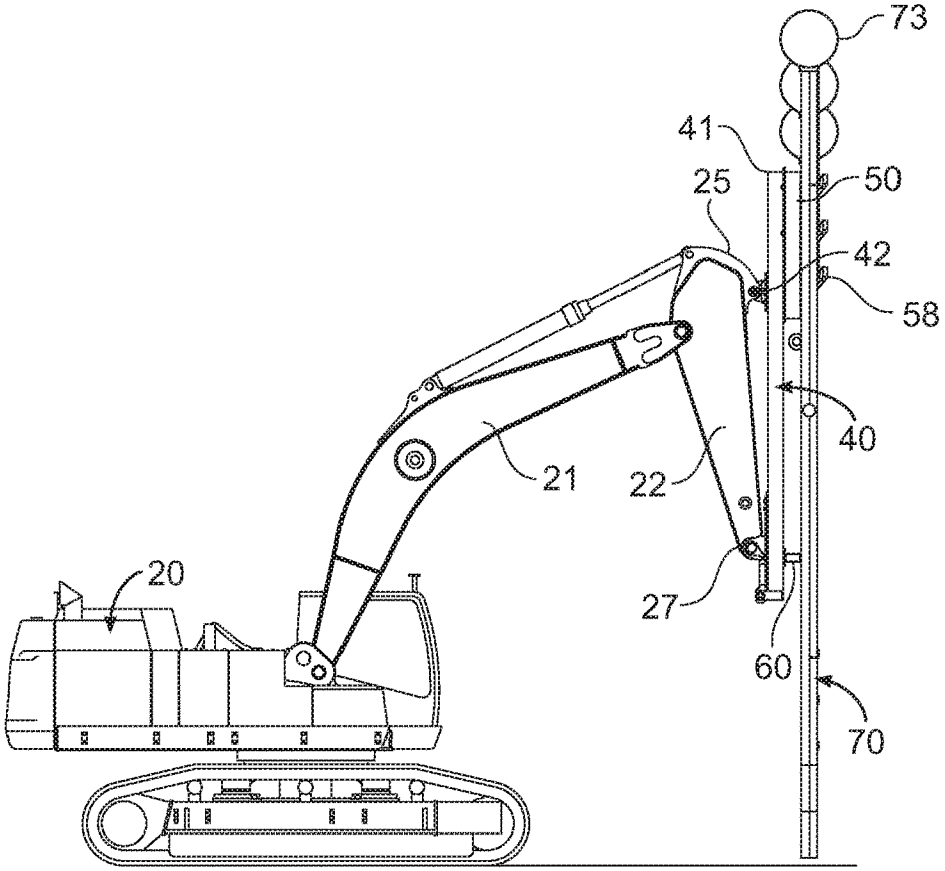
FIG. 2 is a first side view of a structure installation system in accordance with an example embodiment.
Figure 5:
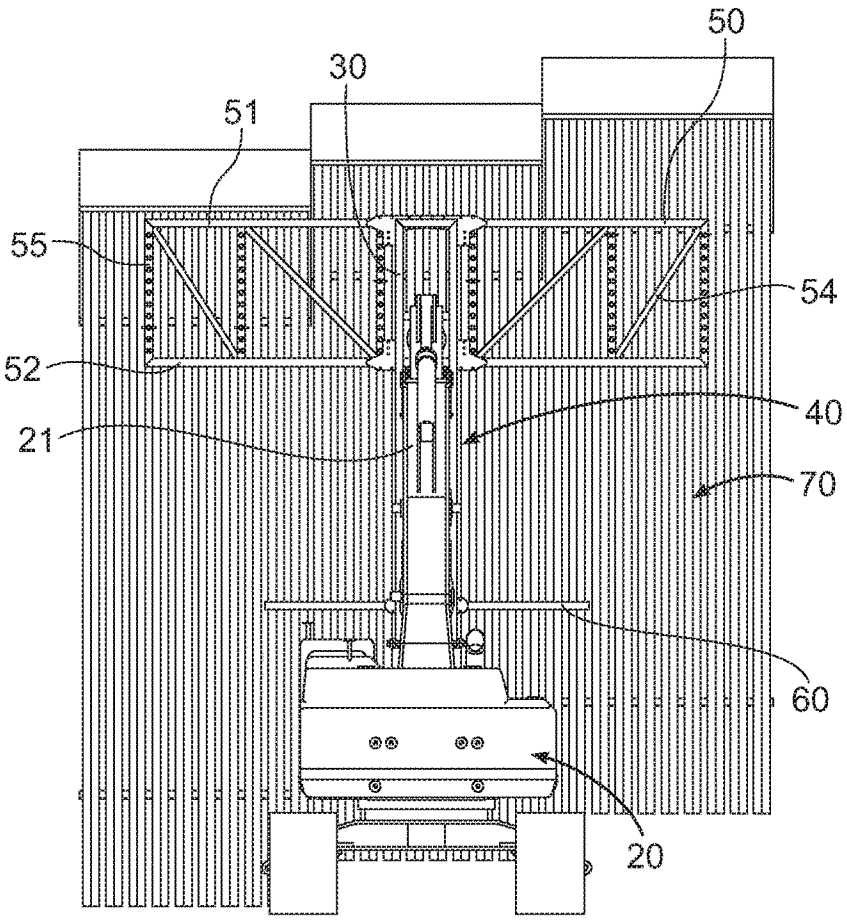
FIG. 5 is a rear view of a structure installation system in accordance with an example embodiment.
Figure 4:
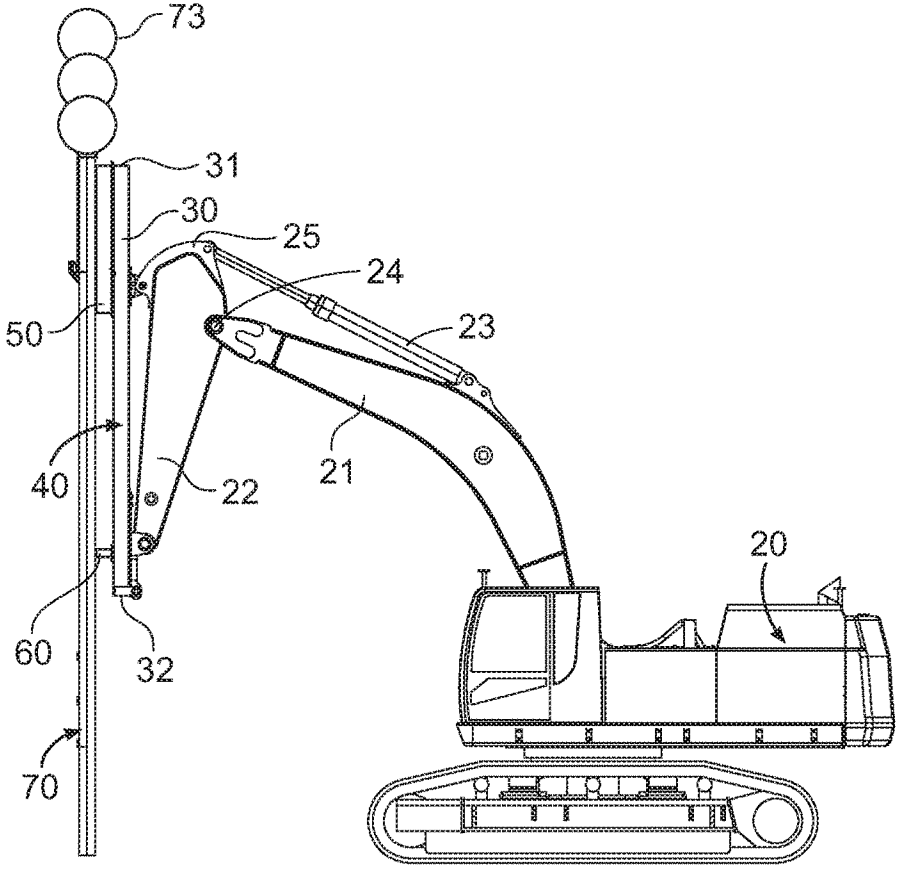
FIG. 4 is a second side view of a structure installation system in accordance with an example embodiment.
Figure 6:
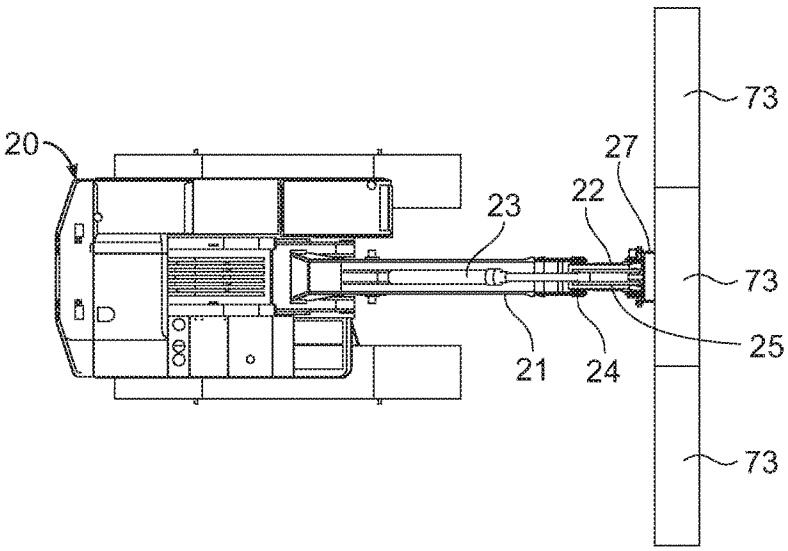
FIG. 6 is a top view of a structure installation system in accordance with an example embodiment.
Figure 7:
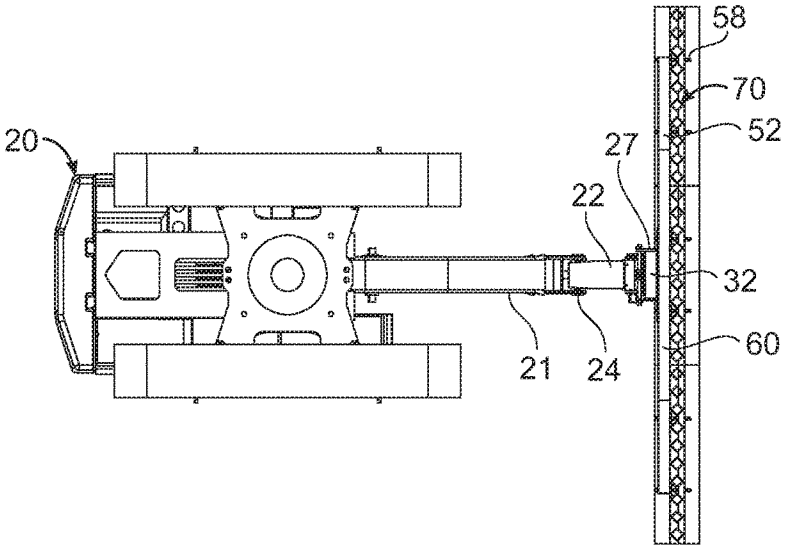
FIG. 7 is a bottom view of a structure installation system in accordance with an example embodiment.

As shown in FIGS. 2 and 4, a hydraulic actuator 23 is illustrated as being connected between the arm 21 and the arm coupler 22 so as to adjust the pitch of the arm coupler 22. In embodiments in which additional or different axes of rotation are implemented, additional actuators 23 may be utilized. Further, it should be appreciated that various types of actuators 23 may be utilized, and thus the scope should not be construed as limited to hydraulic actuators 23.

The arm coupler 22 may be adapted to connect to a support 30; with the support 30 being adapted to support one or more wall sections 70 in a desired position and orientation when forming a structure 16. The manner in which the arm coupler 22 connects to the support 30 may vary in different embodiments. The figures and description herein provide merely exemplary embodiments of the arm coupler 22, and it should be appreciated that various aspects of the arm coupler 22, including its size, orientation, shape, number of connectors 25, 27, and the like may vary in different embodiments to suit different applications.

As best shown in FIG. 2, the arm coupler 22 may be connected to a coupler 40 of the support 30. In some embodiments, the support 30 may be fixedly connected to the arm 21. In embodiments such as shown in the figures, the support 30 may be removably connected to the arm 21.

Figure 11:
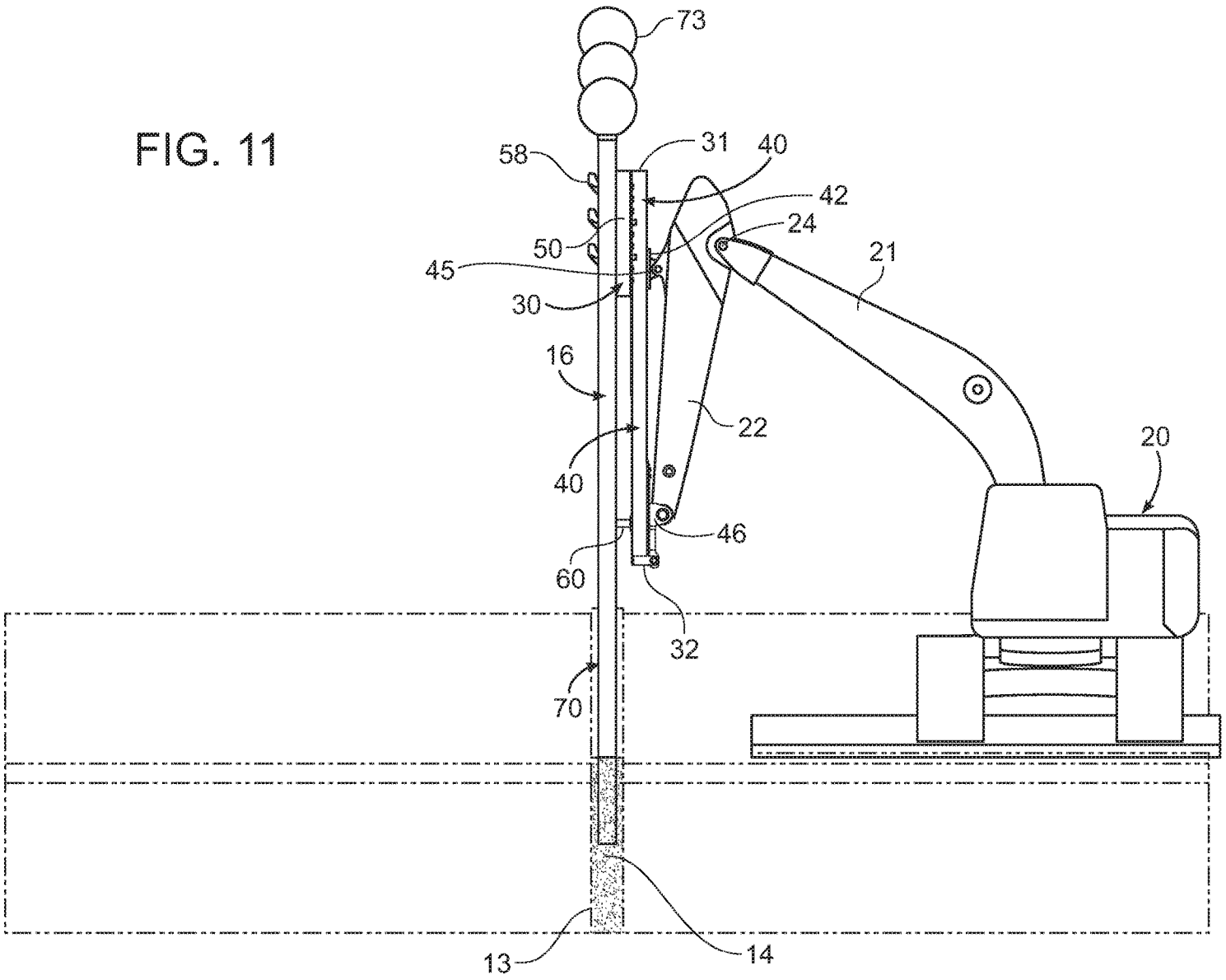
FIG. 11 is a side view of a structure installation system with walls being retained in a desired position and orientation while concrete is allowed to cure in accordance with an example embodiment.
Figure 12:
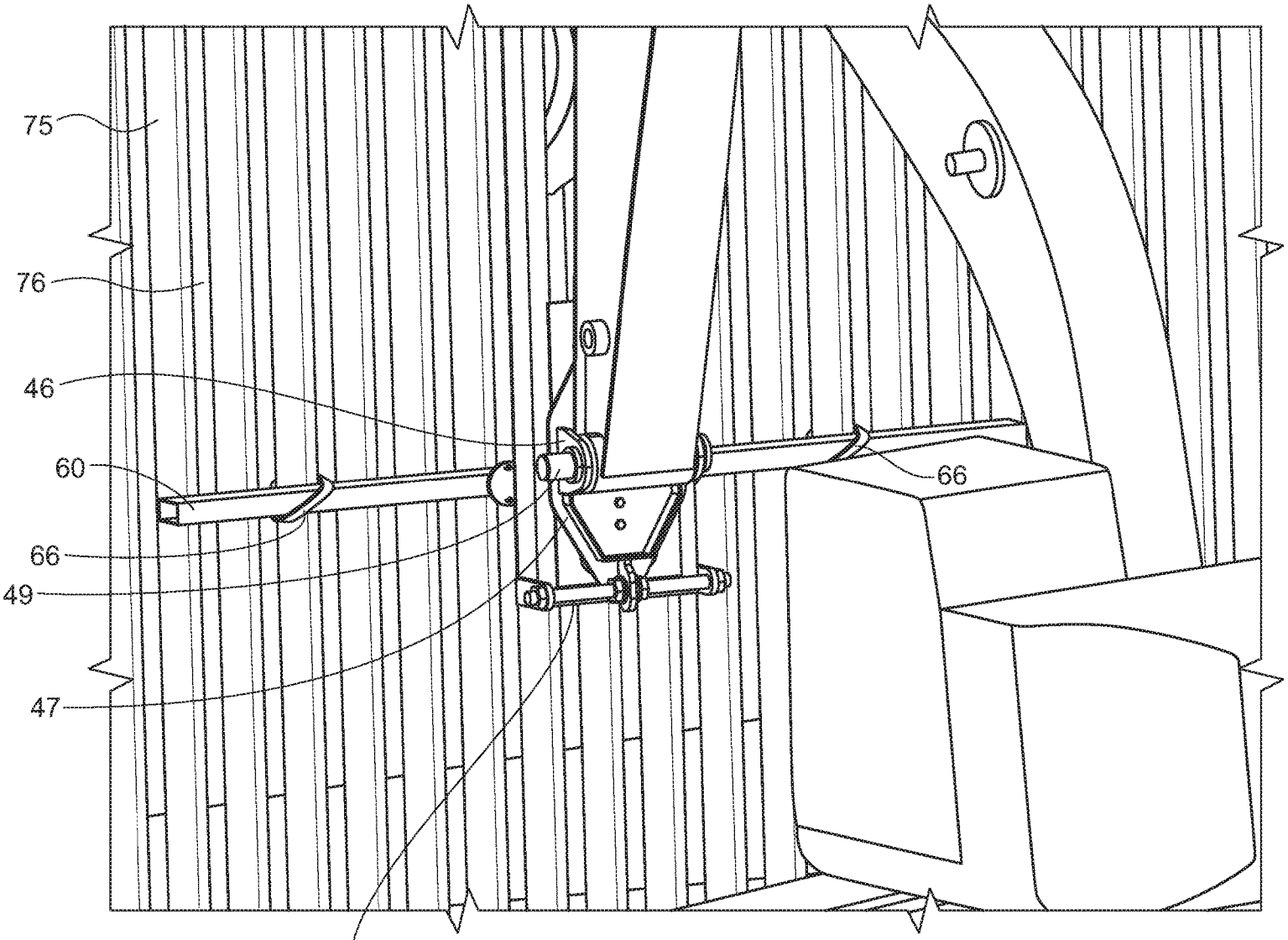
FIG. 12 is a perspective view of a second connector of a coupler of a structure installation system in accordance with an example embodiment.
Figure 13:
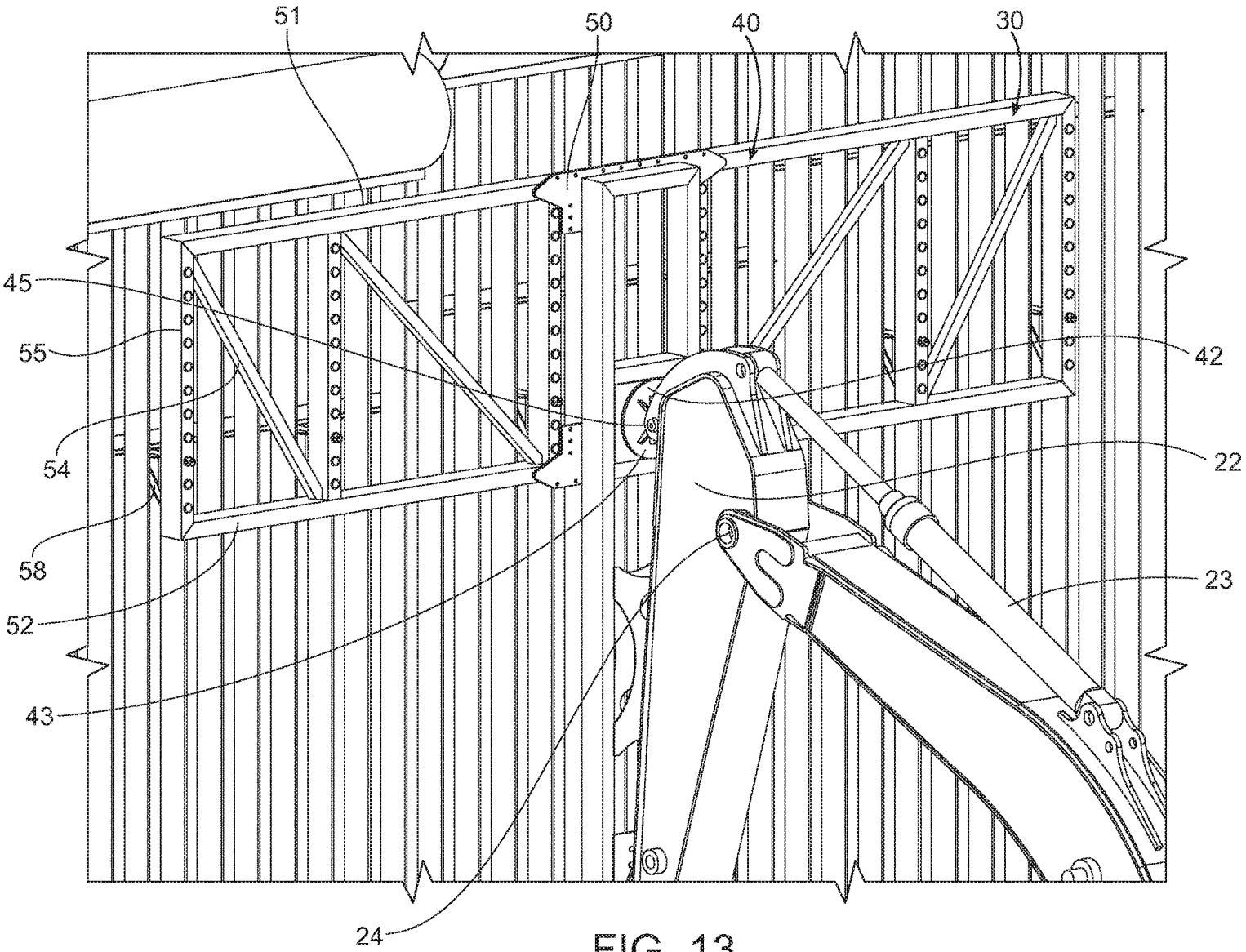
FIG. 13 is a perspective view of a first connector of a coupler of a structure installation system in accordance with an example embodiment.

In the exemplary embodiment best shown in FIG. 11, the arm coupler 22 is illustrated as comprising a first arm connector 25 and a second arm connector 27. The first arm connector 25 may be connected to a first connector 42 of the coupler 40 of the support 30 such as shown in FIG. 13. The second arm connector 27 may be connected to a second connector 46 of the coupler 40 of the support 30 such as shown in FIG. 12.

Various other configurations could be utilized in different embodiments. For example, in some embodiments the arm coupler 22 and/or the coupler 40 of the support 30 may include more or less connectors 25, 27, 42, 46 than is shown in the exemplary embodiments of the figures.

Figure 23:
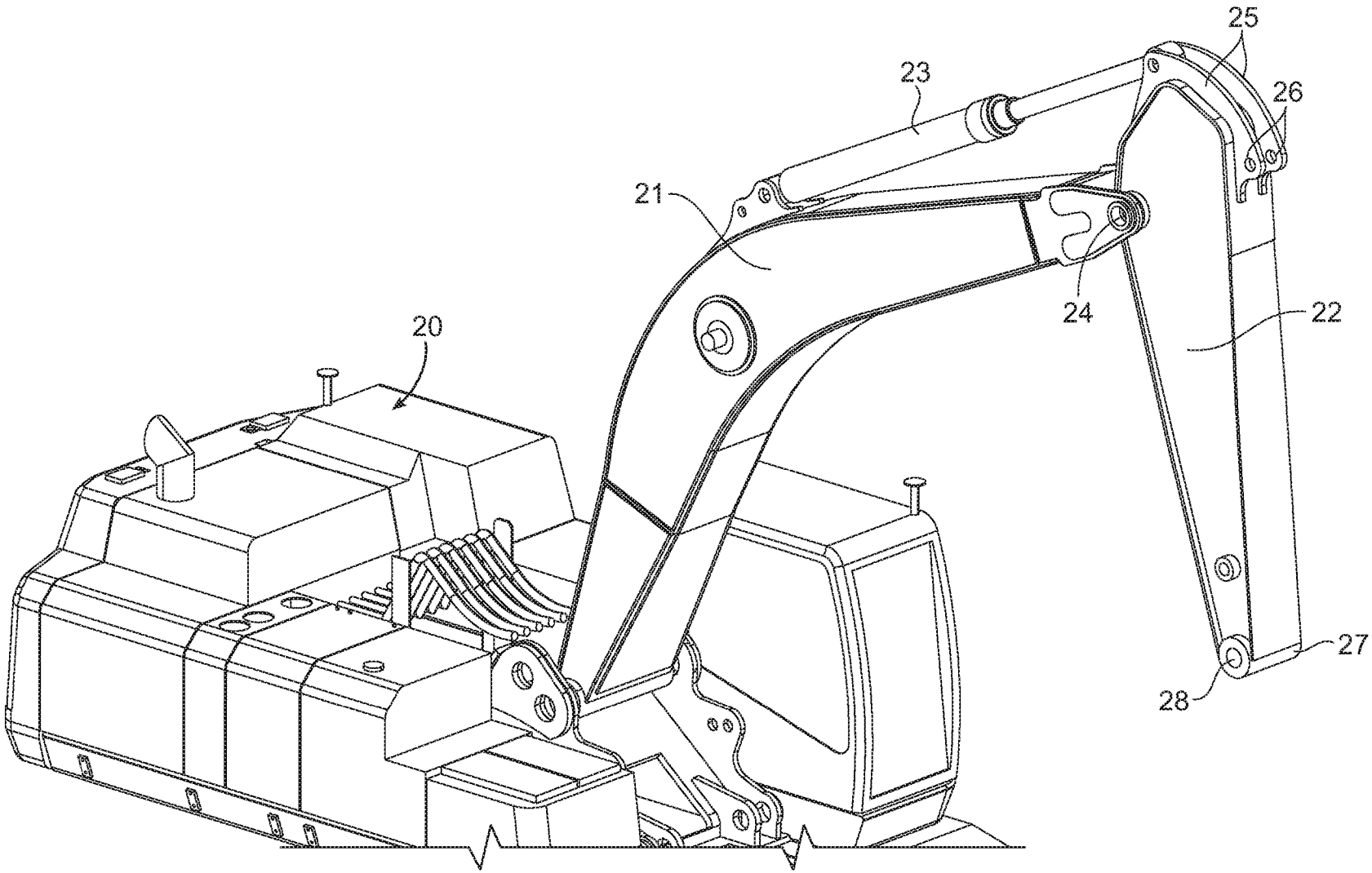
FIG. 23 is an upper perspective view of a vehicle of a structure installation system in accordance with an example embodiment.

As best shown in FIG. 23, the first arm connector 25 may comprise a bracket-type structure, such as a pair of spaced-apart members with aligned openings that form first receivers 26. The first receivers 26 may be adapted to receive a first connector pin 45 to interconnect the first connector 42 of the coupler 40 with the first arm connector 25 of the arm 21. The first arm connector 25 may be configured to provide a pivotable connection between the first arm connector 25 and the first connector pin 45 in some embodiments.

As best shown in FIG. 23, the second arm connector 27 may comprise an opening or a cylindrical member which forms a second receiver 28. The second receiver 28 may be adapted to receive a second connector pin 49 to interconnect the second connector 46 of the coupler 40 with the second arm connector 27 of the arm 21. The second arm connector 27 may be configured to provide a pivotable connection between the second arm connector 27 and the second connector pin 49 in some embodiments.

While the figures illustrate that the arm coupler 22 comprises arm connectors 25, 27 which include receivers 26, 28 for receiving a corresponding pin 45, 49, it should be appreciated that the reverse configuration could be utilized in some embodiments. In such embodiments, the arm coupler 22 may comprise pins and the coupler 40 of the support 30 may comprise receivers such as openings.

C. Support.

Figure 15:
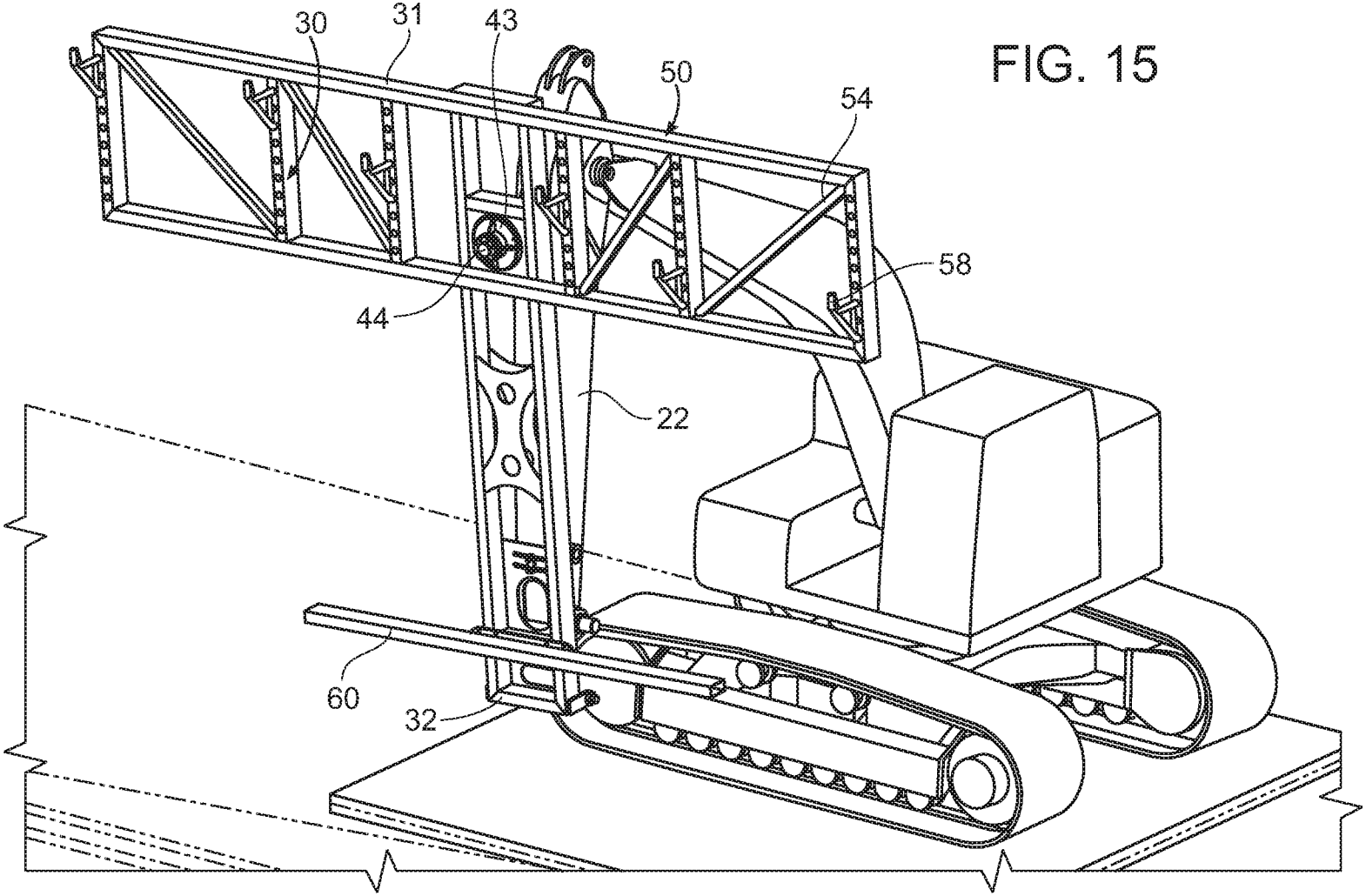
FIG. 15 is a perspective view of a structure installation system without walls attached in accordance with an example embodiment.
Figure 16:
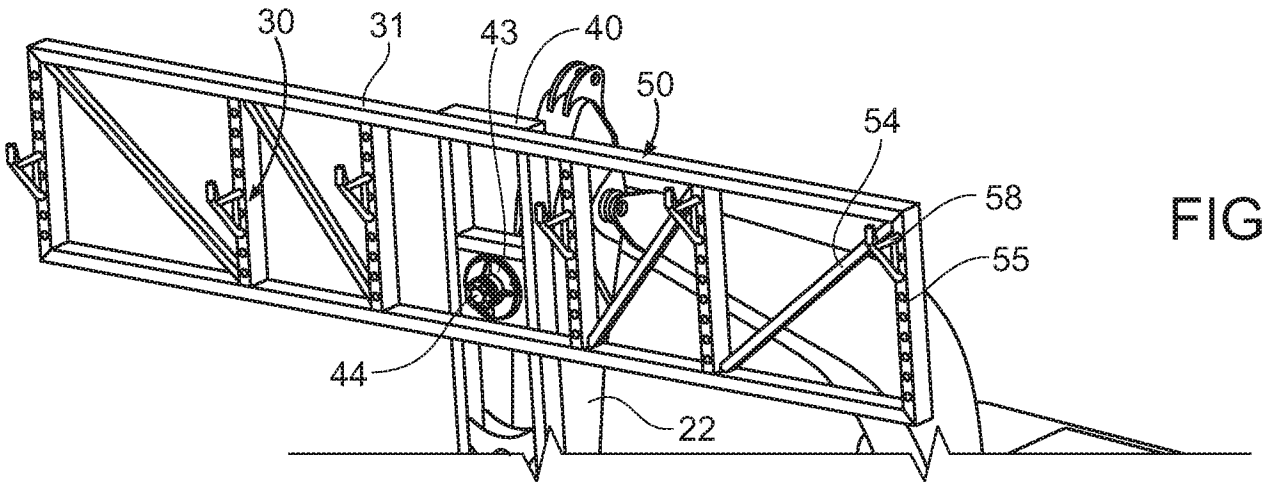
FIG. 16 is a perspective view of a hanger frame with a first arrangement of hangers of a structure installation system in accordance with an example embodiment.
Figure 17:
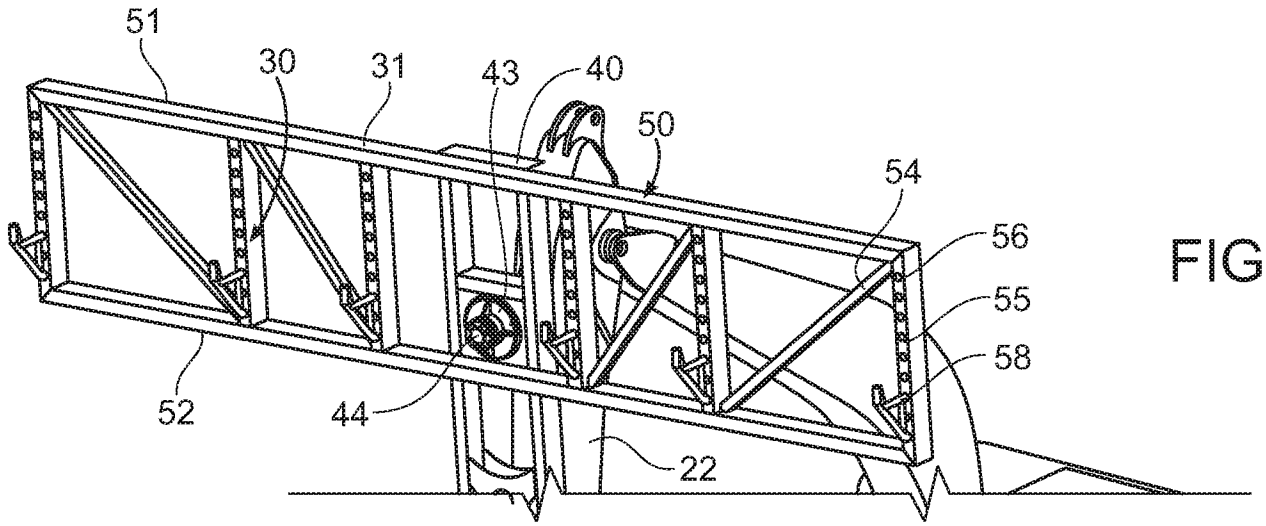
FIG. 17 is a perspective view of a hanger frame with a second arrangement of hangers of a structure installation system in accordance with an example embodiment.

As best shown in FIGS. 15-17, a support 30 may be connected to the arm 21 of the vehicle 20. The support 30 may be connected to the arm coupler 22 of the arm 21 of the vehicle 20 such as shown in the figures. More specifically, the first and second arm connectors 25, 27 of the arm coupler 22 may be connected to the support 30. The support 30 may be removably or fixedly connected to the arm 21 in different embodiments.

In the exemplary embodiment shown in FIG. 15, the support 30 is illustrated as comprising a coupler 40, a hanger frame 50, and a brace 60. It should be appreciated that various other configurations may be utilized for the support 30 to suit different applications. By way of example, the brace 60 may be omitted in some embodiments; with the support 30 relying on the hanger frame 50 to support the walls 70.

As shown in FIG. 15, the support 30 may comprise an upper end 31 and a lower end 32. A coupler 40 adapted to connect the support 30 with the arm 21 may extend from the upper end 31 to the lower end 32 of the support 30 as shown in the figures. In alternate embodiments, the coupler 40 may not extend for the entire height of the support 30.

The upper end 31 of the support 30 may include a hanger frame 50 which is adapted to removably secure a plurality of hangers 58 onto which the walls 70 may be secured. The hanger frame 50 may also act as a brace and support for the walls 70 when they are secured to the hangar frame 50 by the hangers 58.

As shown in FIG. 15, the lower end 32 of the support 30 may include a brace 60 comprised of a horizontal, elongated member. The brace 60 may be adapted to provide additional bracing and support for the walls 70 which are secured to the hanger frame 50 by the hangers 58. In some embodiments, the brace 60 may be omitted.

The support 30 is illustrated as comprising an "I-shaped" or "T-shaped" configuration. It should be appreciated that the shape, size, and configuration of the support 30 may vary in different embodiments and need not necessarily match the exemplary embodiments shown in the figures.

i. Coupler.

Figure 22:
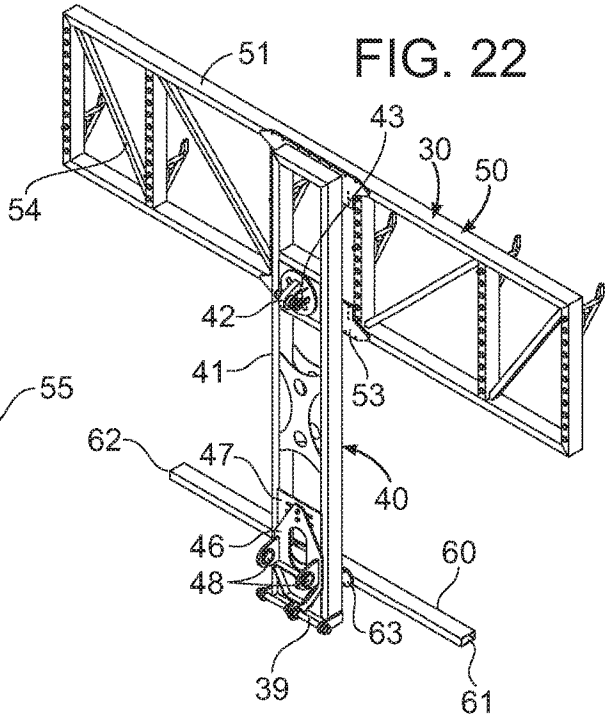
FIG. 22 is an upper perspective view of a support of a structure installation system in accordance with an example embodiment.
Figure 20:
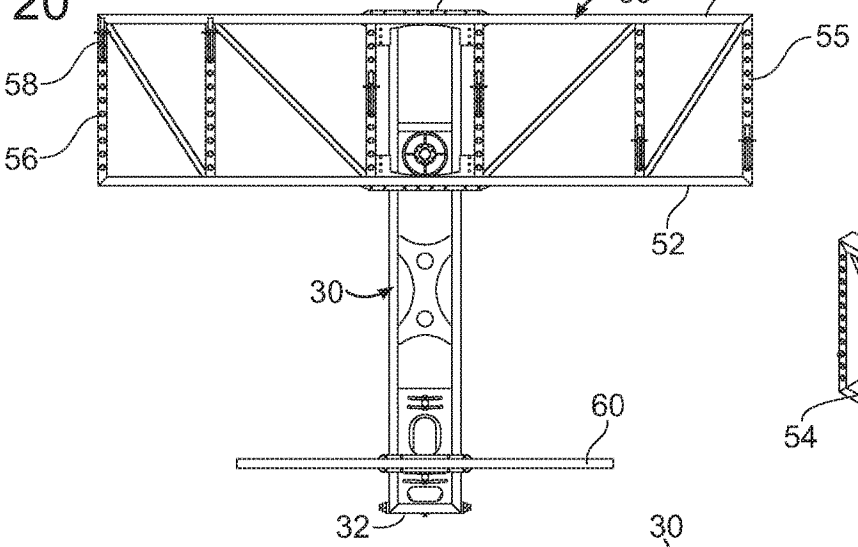
FIG. 20 is a front view of a support of a structure installation system in accordance with an example embodiment.
Figure 21:
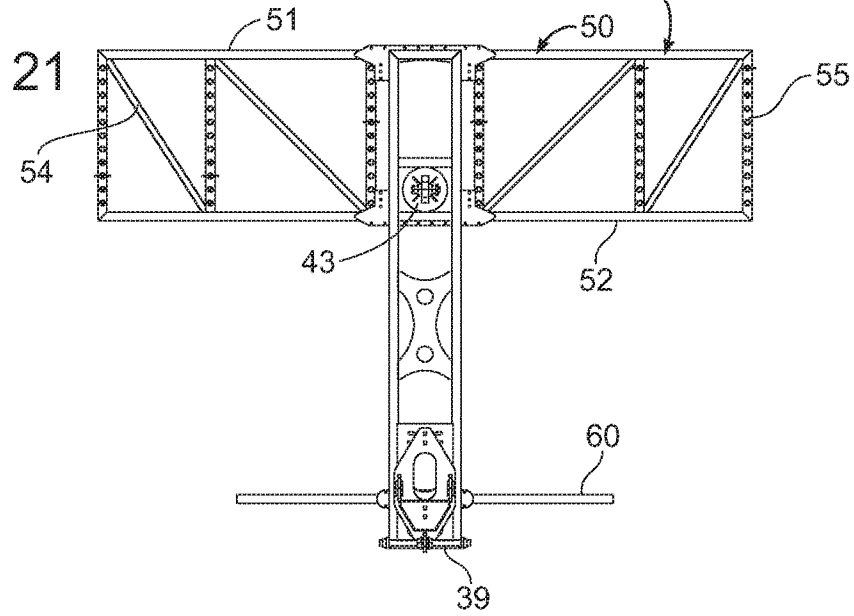
FIG. 21 is a rear view of a support of a structure installation system in accordance with an example embodiment.

As best shown in FIGS. 20-22, the support 30 may comprise a coupler 40 which is used to connect the support 30 to the arm 21 of the vehicle 20. By way of example, the coupler 40 of the support 30 may be adapted to engage with a corresponding arm coupler 22 on the arm 21. The type of coupler 40 utilized may vary in different embodiments and should not be construed as limited by the exemplary figures.

As best shown in FIGS. 20-22, the coupler 40 may comprise a central support 41 which extends between the upper end 31 and the lower end 32 of the support 30. In the figures, the central support 41 is illustrated as comprising a vertical, elongated, rectangular frame member. Various other configurations could be utilized in different embodiments.

As shown in FIG. 21, the coupler 40 may comprise a pair of connectors 42, 46 for connecting the coupler 40 to the arm 21. A first connector 42 is illustrated as being adapted to engage with a corresponding first arm connector 25 on the arm 21. A second connector 46 is illustrated as being adapted to engage with a corresponding second arm connector 27 on the arm 21. In some embodiments, one of these connectors 42, 46 may be omitted, or additional connectors 42, 46 could be utilized.

The first connector 42 is best shown in FIG. 13. The first connector 42 may be positioned near to the upper end 31 of the support 30 (in the figures, the first connector 42 is approximately a fifth of the length of the central support 41 from the upper end 31 of the support 30).

The first connector 42 will preferably be pivotable such that the support 30 may pivot with respect to the arm 21. The support 30 may pivot about a roll axis with respect to the arm 21. The first connector 42 may thus be comprised of a pivotable connector, such as a bearing, axle, or the like. This allows the roll of the support 30 to be adjusted to ensure that the walls 70 are properly oriented, even when the vehicle 12 is on tilted or uneven ground.

In the exemplary embodiment of the figures, the first connector 42 comprises a pivot base 43 which is adapted to pivot about a pivot pin 44 which extends through the pivot base 43. The pivot pin 44 may extend through the coupler 40 such as shown in FIG. 15; with the pivot base 43 (and support 30 as a whole) pivoting about the pivot pin 44. The pivot base 43 may in some embodiments comprise a bushing which rotates about the pivot pin 44.

The first connector 42 may include a first connector pin 45 which is adapted to extend through and engage with the first receivers 26 of the first arm connector 25 of the arm coupler 22. Thus, the first connector pin 45 may extend through the first receivers 26 to engage the first arm connector 25 of the arm coupler 22 with the first connector 42 of the coupler 40.

As best shown in FIG. 12, the second connector 46 of the coupler 40 may be positioned at or near the lower end 32 of the support 30. The second connector 46 is positioned so as to interconnect and engage with the corresponding second arm connector 27 on the arm 22 coupler.

The second connector 46 may include a mount 47 which connects the second connector 46 to the central support 41 of the coupler 40 such as shown in FIGS. 20-22. The mount 47 may comprise a plate or other member which may be connected to the central support 41 by fasteners or the like. The second connector 46 may be connected to the mount 47 and/or the central support 41. The central support 41 may also include a cross connector 39, such as one or more elongated rods or the like, to which the second connector 46 may be connected such as shown in FIG. 12. The cross connector 39 may be positioned at the lower end 32 of the support 30 as shown in the figures.

The second connector 46 may comprise various configurations. In the embodiment shown in the figures, the second connector 46 may comprise a bracket including a pair of aligned second connector receivers 48, or openings, through which a second connector pin 49 may be inserted. The second connector 46 may thus be aligned with the second arm connector 27 such that the second connector receivers 48 are aligned with the second receivers 28 of the second arm connector 27. The second connector pin 49 may be inserted through both the second connector receivers 48 and the second receivers 28 to interconnect the second connector 46 of the coupler 40 with the second arm connector 27 of the arm coupler 22.

ii. Hanger Frame.

As best shown in FIGS. 15-17, the support 30 may comprise a hanger frame 50. The hanger frame 50 is adapted to support the walls 70 at a desired position and orientation when the structure 16 is being installed. The hanger frame 50 may be connected at or near the upper end 31 of the support 30, or at other locations in different embodiments.

The hanger frame 50 is illustrated as comprising a rectangular frame which includes a plurality of vertically-oriented hanger supports 55. The hanger frame 50 may include a plurality of hangers 58 to which the walls 70 may be removably connected during the installation process of the structure 16, and then released once the structure 16 is installed (such as after curing concrete 14).

The hanger frame 50 will generally be connected to the coupler 40, such as by a first mount 53 as shown in FIG. 22. The hanger frame 50 may be connected to the coupler 40 by fasteners or by welding or the like. The first mount 53 may comprise a plate-like member which interconnects the coupler 40 with the hanger frame 50. In some embodiments, the first mount 53 may be omitted; with the hanger frame 50 directly connected to the coupler 40.

In the exemplary embodiments shown in the figures, the hanger frame 50 may extend perpendicularly with respect to the central support 41 of the coupler 40. The width of the hanger frame 50 may vary widely between different embodiments depending on the type of walls 70 being installed and how many walls 70 are meant to be supported at once.

As best shown in FIGS. 16, 17, and 20-22, the hanger frame 50 may comprise a plurality of hanger supports 55. The hanger supports 55 are illustrated as being vertically-oriented, though they could be oriented in other manners in different embodiments. Each of the hanger supports 55 may comprise an elongated member such as a rod or the like. Cross supports 54 comprised of elongated members such as a rod or the like may extend diagonally to provide additional stability to the hanger frame 50.

As shown in FIGS. 16-17, a plurality of hangers 58 may be connected to the hanger frame 50. The hangers 58 are adapted to removably engage with and connect to the walls 70 such that the walls 70 may be supported on the hanger frame 50 in a desired position and orientation during installation. The hangers 58 may be adapted to be easily disengaged from the walls 70 after the walls 70 have been set in concrete 14.

The shape, structure, and configuration of the hangers 58 may vary in different embodiments. In an exemplary embodiment shown in FIG. 16, each hanger 58 is illustrated as comprising a pair of members (one diagonal, one horizontal) which fit into a pair of the hanger receivers 56 of the hanger supports 55. A projection extends upwardly from the intersection of the diagonal and horizontal members; with the wall 70 resting on the projection such as shown in FIG. 8.

As shown in FIGS. 16-17, the hangers 58 may be removably connected to the hanger frame 50. This allows for the hangers 58 to be adjusted in positioning and spacing to accommodate different configurations of walls 70 and ground surfaces 12. For example, on a slanted or uneven ground surface, it may be preferable to stagger the different walls 70; such as with a first wall 70*a* at a first height, a second wall 70*b* at a second height, and a third wall 70*c* at a third height. In such situations, the hangers 58 may be adjusted to allow for the walls 70*a*, 70*b*, 70*c* to be so oriented.

To accommodate different hanger 58 arrangements, the hanger frame 50 may comprise a plurality of hanger receivers 56 to which the hangers 58 may be selectively connected. The hanger receivers 56 are illustrated as comprising openings in which the hangers 58 may be connected, though other configurations could be utilized in different embodiments.

In the embodiment shown in FIG. 16, the hanger supports 55 comprise a plurality of hanger receivers 56 extending along the length of the hanger supports 55. Thus, the hangers 58 may be selectively mounted to different pairs of hanger receivers 56 to adjust hanger 58 arrangements such as shown in FIGS. 16-17. FIG. 16 illustrates a staggered arrangement of hangers 58. FIG. 17 illustrates an in-line arrangement of hangers 58. A wide range of other combinations of hangers 58 may be utilized to accommodate a wide range of other arrangements; providing the ability to accommodate different types of structures 16, ground surfaces 12, and walls 70.

iii. Brace.

As shown in FIG. 12, the support 30 may comprise a brace 60 which acts as provides support for the walls 70 when they are connected to the hanger frame 50. The brace 60 may comprise an elongated member having a first end 61 and a second 62. The brace 60 may extend perpendicularly with respect to the central support 41 of the coupler 40.

As shown in FIG. 12, the brace 60 may be connected to the lower end 32 of the support 30 by a second mount 63. The second mount 63 may interconnect the brace 60 with the central support 41 of the coupler 40 such as shown in FIG. 12. In other embodiments, the brace 60 may be directly connected to the central support 41 of the coupler 40. The manner in which the brace 60 is so connected may vary, including the use of fasteners or welding.

The brace 60 is illustrated as being shorter in length than the hanger frame 50. It should be appreciated that in some embodiments the brace 60 may be longer or shorter than the hanger frame 50. In other embodiments, the brace 60 may be omitted entirely if additional bracing is not needed or desired.

The brace 60 is adapted to brace against the wall 70 so as to support the wall 70 in a desired position or orientation during installation. In some embodiments where additional bracing is desired, straps 66 may be utilized to secure the brace 60 to the walls 70. For example, FIG. 12 illustrates the use of straps 66 which are tied around both the brace 60 and vertical beams 75 of the walls 70 to secure the walls 70 to the brace 60. The straps 66 may be easily removed after installation. The straps 66 may comprise ratchet straps in some embodiments.

D. Walls.

It should be appreciated that the methods and systems described herein may be utilized to install a wide range of structures 16, including walls, fences, barriers, and the like. Using the methods and systems described herein, multiple walls 70 may be positioned at a desired position and orientation by the vehicle 20 while concrete 14 is poured and allowed to cure to form the unitary structure 16. The methods and systems described herein should not be construed as limited to any particular type of wall 70 or structure 16.

The use of the term "wall" herein should not be construed as limited to any particular type of wall 70 or panel and instead should be construed as encompassing both singular walls 70 which form the entire structure 16 or individual wall 70 panels which together form the structure 16. Thus, the walls 70 may comprise panels which, together, form a wall 70 or other structure 16.

The methods and systems described herein should not be construed as limited to any particular type of wall 70 or structure 16. For example, the wall 70 could comprise a fence or fence panels that are installed together to form a fence structure 16. The wall 70 could comprise any type of barrier, or it could comprise panels which are installed together to form any type of barrier.

The methods and systems described herein allow for walls 70 to be maintained in a desired position and orientation while the walls 70 are set in concrete to form a structure 16. The figures illustrate that the support 30 may support multiple walls 70 which significantly reduces the amount of time necessary to construct the structure 16.

The types of walls 70 used with the methods and systems described herein may vary in different embodiments. The walls 70 may comprise panels which, when formed together, form the structure 16. In the exemplary embodiments shown in the figures, the walls 70 are illustrated as comprising bollard walls which comprise a plurality of vertical beams 75 with slots 76 defined between the vertical beams 75.

As shown in the figures, each of the walls 70 may comprise an upper end 71 and a lower end 72. The upper end 72 may include a cylindrical reinforcement structure 73 which ties together the vertical beams 75 of the wall 70 such as shown in FIGS. 8-9. The lower end 72 of the walls 70 are adapted to be set in concrete 14 in a concrete fill area 13 such as a trough formed in the ground surface 12. After the concrete 14 has been set, the walls 70 will be self-supported to form the overall structure 16.

The walls 70 may each include a catch portion 74 to which the hangers 58 may be connected. The hangers 48 will generally extend through the slots 76 of the walls 70 between their vertical beams 75 and catch onto the catch portion 74. In some embodiments, the catch portion 74 may comprise the lower end of a reinforcement structure 73 tying the top of the vertical beams 75 together such as shown in FIG. 8. In other embodiments, a separate beam or the like may extend across the wall 70 to serve as a catch portion 74 for the hangers 58.

E. Operation of Preferred Embodiment.

In use, one or more walls 70 may be installed in a ground surface 12, such as to form a larger structure 16. Generally, the walls 70 will be positioned within a concrete fill area 13 that is dug into the ground surface 12 such as shown in FIG. 9. The walls 70 will be retained in a specific position and orientation with respect to both the ground surface 12 and each other.

Figure 10:
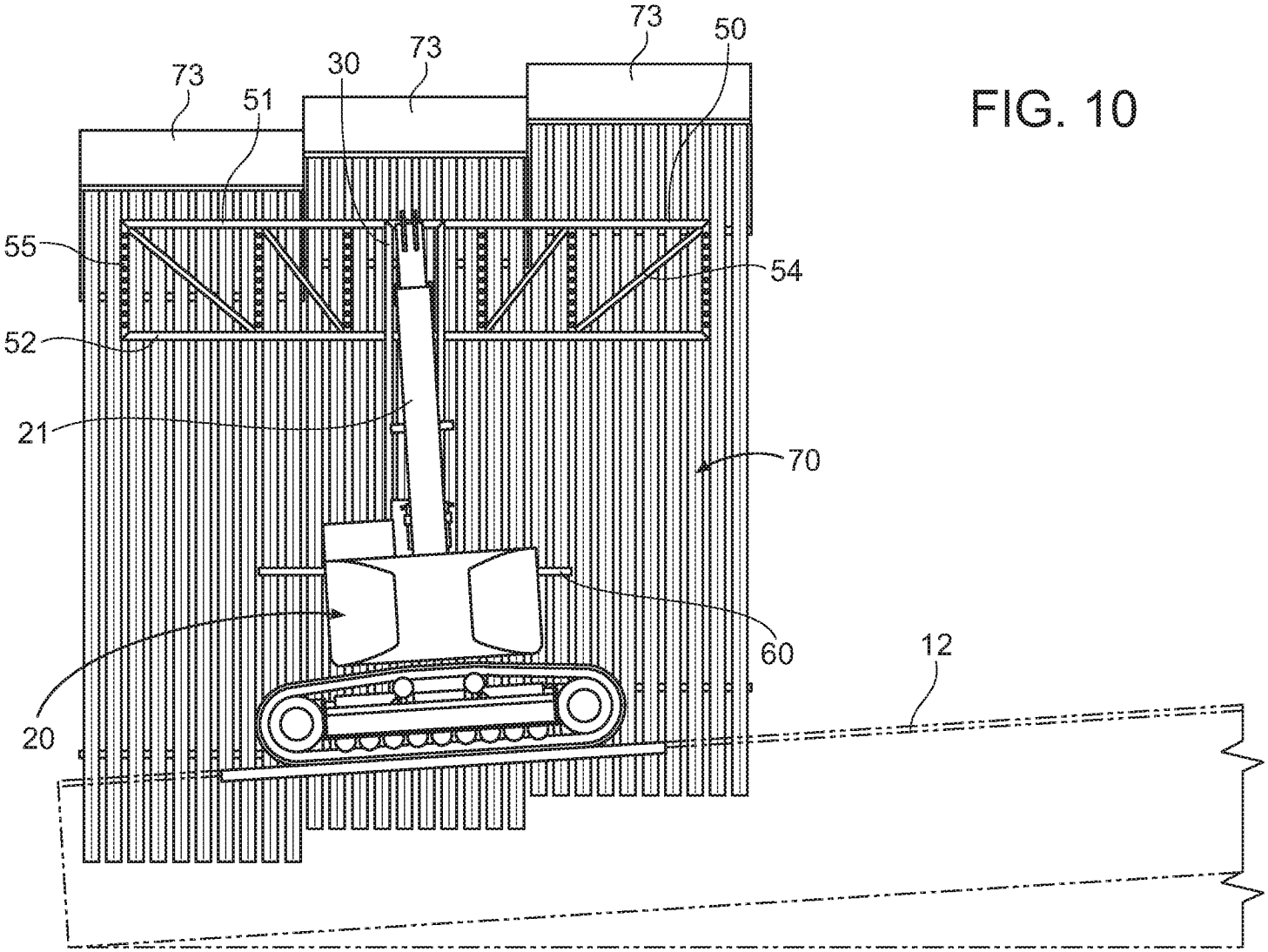
FIG. 10 is a rear view of a structure installation system with walls being retained in a desired position and orientation on an uneven surface in accordance with an example embodiment.

For example, on uneven ground surfaces 12 it may be desired to retain the walls 70 in a staggered configuration, such as shown in FIG. 10. Each of the walls 70 may be supported in such a staggered configuration using the methods and systems described herein while concrete 14 is poured and allowed to cure. After curing, the vehicles 20 may be withdrawn and the structure 16 will be free-standing.

If necessary, the support 30 may first be connected to the vehicle 20. As shown in FIG. 11, the support 30 may comprise a coupler 40 having a first connector 42 and a second connector 46. The coupler 40 may be connected to the arm 21 of the vehicle 20 such that the support 30 is pivotable with respect to the arm 21.

The first connector 42 may be connected to the first arm connector 25 of the arm coupler 22 of the arm 21 of the vehicle 20 such as shown in FIG. 13. The first connector 42 may be pivotable so as to allow the support 30 to be pivoted about one or more axes (including but not limited to pitch and roll) with respect to the arm 21. To connect the first connector 42 to the first arm connector 25, a first connector pin 45 may be inserted through both the first receivers 26 of the first arm connector 25 and the first connector 42 of the coupler 40 such as shown in FIG. 13.

The second connector 46 of the coupler 40 may be connected to the second arm connector 27 of the arm coupler 22 of the arm 21 of the vehicle 20 such as shown in FIG. 12. The second connector 46 may be pivotable so as to allow the support 30 to be pivoted about one or more axes (including but not limited to pitch and roll) with respect to the arm 21. To connect the second connector 46 to the second arm connector 27, a second connector pin 49 may be inserted through both the second receivers 28 of the second arm connector 27 and the second connector receivers 48 of the second connector 46 of the coupler 40 such as shown in FIG. 12.

FIG. 11 illustrates an exemplary embodiment in which the support 30 has been connected to the arm 21 of the vehicle 20 using the arm coupler 22 and the coupler 40. The system is ready for use. One or more walls 70 may be connected to the support 30 as described below. The walls 70 may be adjusted in orientation and position by the vehicle 20 and retained in the desired orientation and position while concrete 14 is poured and allowed to cure within the concrete fill area 13 such as shown in FIG. 11.

The number of walls 70 supported by the support 30 may vary in different embodiments. FIGS. 1-10 illustrate a first wall 70*a*, a second wall 70*b*, and a third wall 70*c* each being supported at different heights by a single support 30 on a single vehicle 20. It should be appreciated that each vehicle 20 could support more or less walls 70 in different embodiments.

Figure 24:
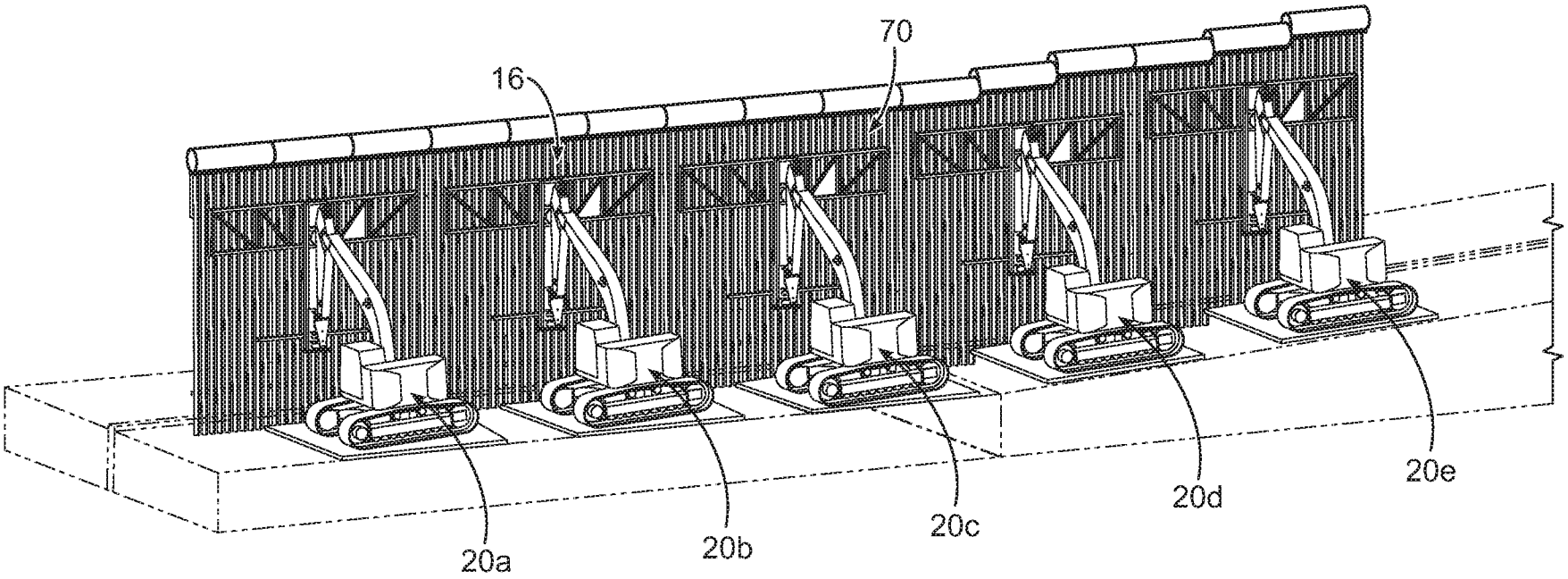
FIG. 24 is a perspective view of multiple vehicles supporting multiple walls in a desired position and orientation of a structure installation system in accordance with an example embodiment.

Multiple vehicles 20*a*, 20*b*, 20*c*, 20*d*, 20*e* may be utilized to create longer structures 16 with minimal effort. FIG. 24 illustrates a first vehicle 20*a* supporting a first set of walls 70, a second vehicle 20*b* supporting a second set of walls 70, a third vehicle 20*c* supporting a third set of walls 70, a fourth vehicle 20*d* supporting a fourth set of walls 70, and a fifth vehicle 20*e* supporting a fifth set of walls 70. The sets of walls 70 may be positioned against each other and supported by the plurality of vehicles 20*a*, 20*b*, 20*c*, 20*d*, 20*e* in a desired orientation and position while concrete 14 is poured and allowed to cure to complete the unitary structure 16.

In an exemplary embodiment shown in FIG. 11, the support 30 comprises a hanger frame 50 including a plurality of hanger supports 55. Each of the hanger supports 55 includes a plurality of spaced-apart hanger receivers 56. The hangers 58 may be selectively and removably connected to any of the hanger receivers 56.

Figure 14:
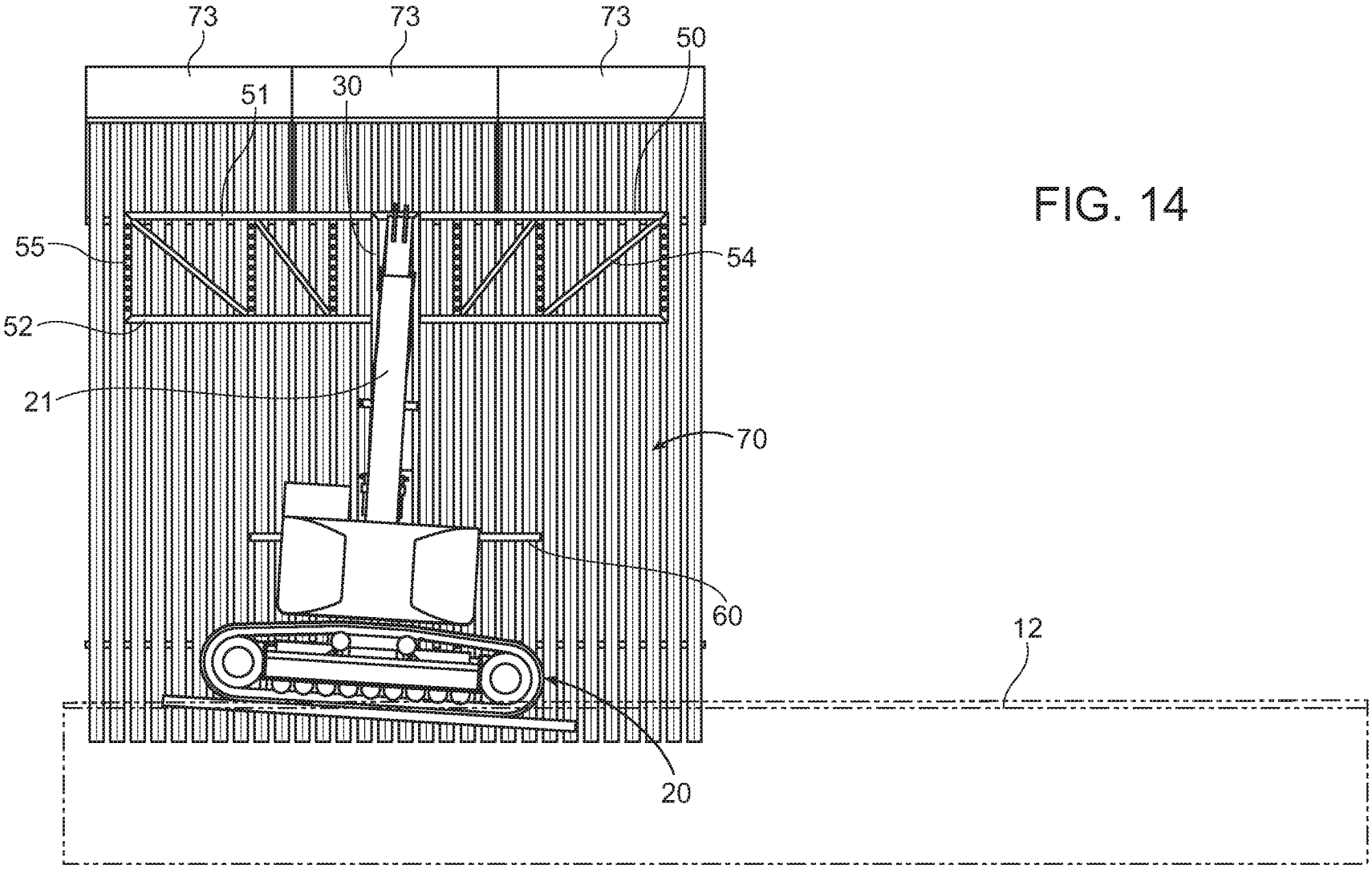
FIG. 14 is a rear view of a structure installation system with walls being retained in a desired position and orientation in accordance with an example embodiment.

The hangers 58 may be selectively positioned along the hanger frame 50 depending on the particular needs of each installation. Different ground surfaces 12 will require different arrangements of walls 70. By pivoting or rotating the support 30 with respect to the arm 21 of the vehicle 20, the walls 70 may be retained in a desired position or orientation regardless of the orientation of the vehicle 20, such as when the vehicle 20 is on uneven ground as shown in FIG. 14.

FIG. 16 illustrates a first exemplary arrangement of hangers 58 which allows for a plurality of walls 70*a*, 70*b*, 70*c* to be staggered in height. This configuration will allow for a straight structure 16 to be formed on uneven ground, as the different heights of each wall 70*a*, 70*b*, 70*c* accommodates for the uneven ground. FIG. 17 illustrates a second exemplary arrangement of hangers 58 which allows for the plurality of walls 70*a*, 70*b*, 70*c* to be supported at a level height. It should be appreciated by one of skill in the art that the positioning of the hangers 58 may be freely adjusted to accommodate a wide range of wall 70 arrangements.

The manner in which the walls 70 are connected to the support 30 may vary in different embodiments. The arm 21 may be manipulated so as to positioned the hangers 58 within the slots 76 of the wall 70, and then the arm 21 may be raised to engage the hangers 58 with the catch portion 74 of the walls 70. The walls 70 may then be lifted with the arm 21 and positioned in place.

Alternatively, a crane or other type of vehicle may support the walls 70 in an upright position and the arm 21 may be manipulated to insert the hangers 58 within the slots 76 of the walls 70. The support 30 may be moved by the vehicle 20 to connect to the walls 70, or the walls 70 may be moved onto the support 30.

Figure 19:
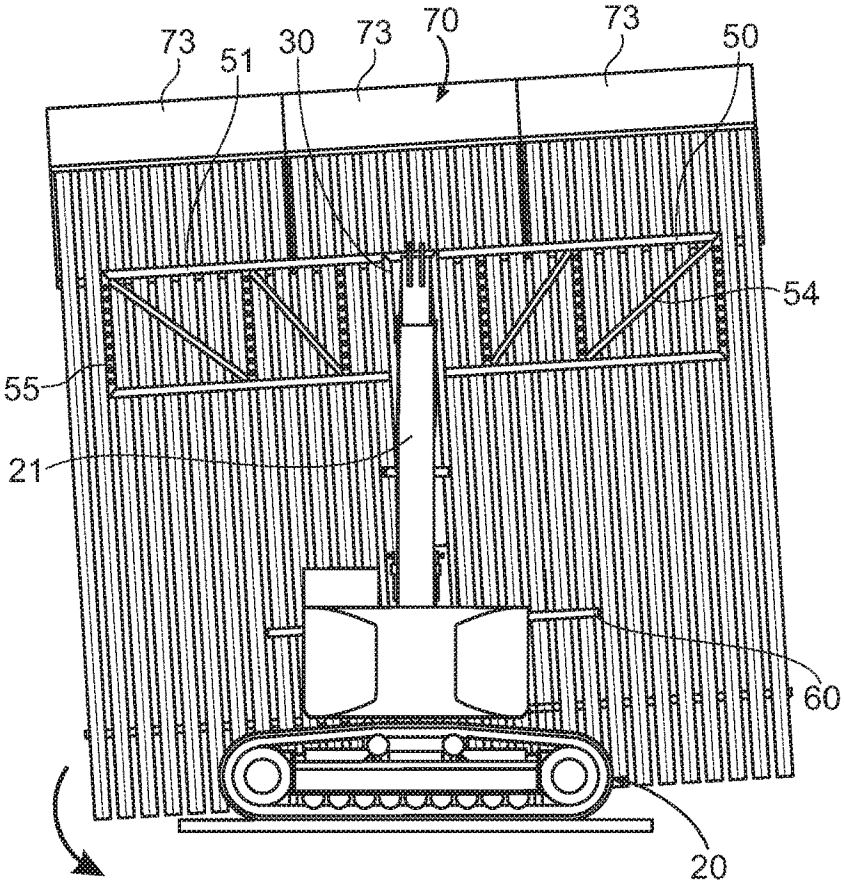
FIG. 19 is a rear view of walls being pivoted into a second orientation of a structure installation system in accordance with an example embodiment.
Figure 18:
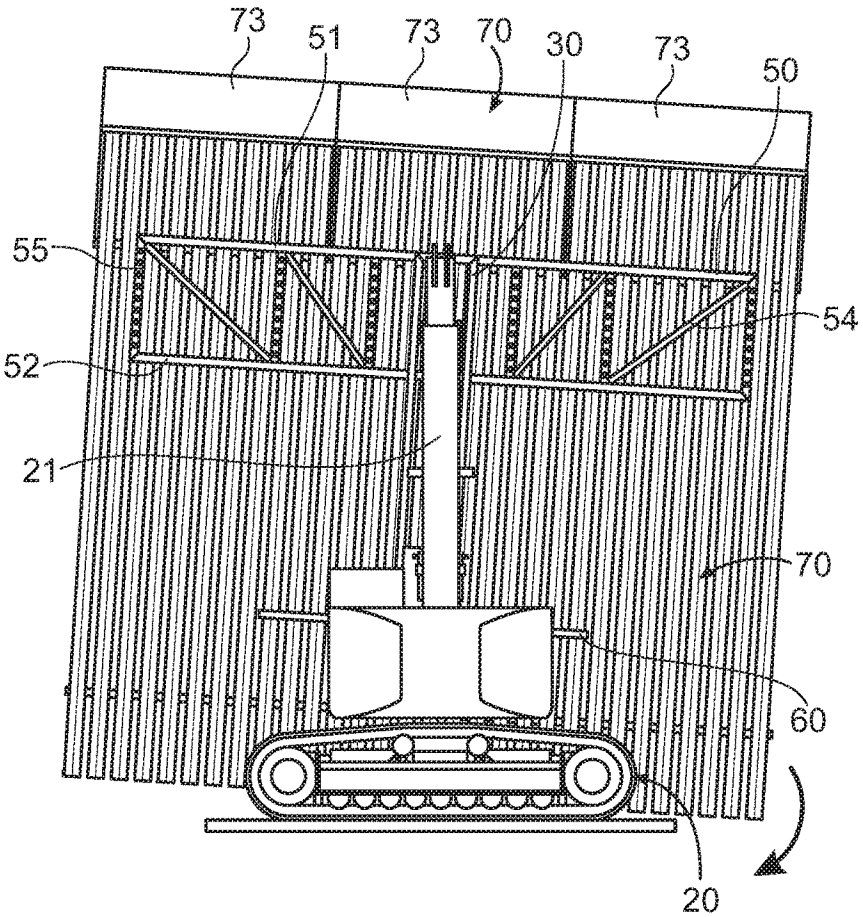
FIG. 18 is a rear view of walls being pivoted into a first orientation of a structure installation system in accordance with an example embodiment.

If desired or necessary, the support 30 may be adjusted about one or more axes with respect to the arm 21 to allow for proper orientation and positioning of the walls 70 during installation. FIGS. 18 and 19 illustrate the support 30 being adjusted about a roll axis with respect to the arm 21. Use of the actuator 23 of the vehicle 20 may be utilized to adjust the support 30 about a pitch axis with respect to the arm 21.

Although not shown, an additional actuator could be utilized to effectuate the adjustment or pivoting about the roll axis. For example, a hydraulic actuator could be connected between the support 30 and the arm coupler 22 such that the support 30 may be adjusted with respect to the arm 21. When the actuator is extended or retracted, the support 30 will pivot about the pivot pin 44 of the coupler 40 such as shown in FIGS. 18 and 19. In embodiments in which an actuator is not provided, the supports 30 may be manually adjusted about the roll axis.

Unless otherwise defined, all technical and scientific terms used herein have the same meaning as commonly understood by one of ordinary skill in the art to which this invention belongs. Although methods and materials similar to or equivalent to those described herein can be used in the practice or testing of the structure installation system, suitable methods and materials are described above. All publications, patent applications, patents, and other references mentioned herein are incorporated by reference in their entirety to the extent allowed by applicable law and regulations. The structure installation system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A wall installation system, comprising:

a vehicle adapted to traverse a ground surface, wherein the vehicle includes:

an arm extending from the vehicle;

a plurality of wheels or a plurality of tracks connected to a motor;

a support connected to the arm of the vehicle, wherein the support is rotatable about at least one axis with respect to the arm of the vehicle, wherein the support is rotatable about a roll axis with respect to the arm, wherein the support comprises an upper end and a lower end; and a plurality of hangers connected to the support, wherein the plurality of hangers are adapted to removably connect to a bollard wall having a plurality of vertical beams and a plurality of slots, wherein each of the plurality of hangers is adapted to removably connect within one of the plurality of slots of the bollard wall, wherein the support is adapted to retain the bollard wall in a desired position and orientation with respect to the ground surface during installation of the bollard wall in the ground surface;

wherein each of the plurality of hangers is comprised of a horizontal portion, wherein the horizontal portion of each of the plurality of hangers is connected to the support, and wherein the horizontal portion of each of the plurality of hangers is adapted to extend through one of the plurality of slots of the bollard wall.

2. The wall installation system of claim 1, wherein the plurality of hangers are removably connected to the support.

3. The wall installation system of claim 1, wherein the support comprises a hanger frame.

4. The wall installation system of claim 3, wherein the hanger frame comprises a plurality of hanger supports.

5. The wall installation system of claim 4, wherein each of the plurality of hangers is removably connected to one of the plurality of hanger supports of the hanger frame.

6. The wall installation system of claim 5, wherein each of the plurality of hanger supports of the hanger frame comprises a plurality of hanger receivers, each of the plurality of hanger receivers comprising an opening adapted to removably receive one of the plurality of hangers.

7. The wall installation system of claim 3, wherein the support comprises a brace adapted to rest against the bollard wall.

8. The wall installation system of claim 7, wherein the hanger frame is connected to the upper end of the support and wherein the brace is connected to the lower end of the support.

9. The wall installation system of claim 7, wherein the support comprises a coupler, wherein the coupler of the support is removably connected to the arm of the vehicle.

10. The wall installation system of claim 9, wherein the coupler comprises a first connector, wherein the first connector is pivotably connected to the arm.

11. The wall installation system of claim 10, wherein the coupler comprises a second connector, wherein the second connector is connected to the arm.

12. A wall installation system, comprising:

a vehicle adapted to traverse a ground surface, wherein the vehicle includes:

an arm extending from the vehicle;

a plurality of wheels or a plurality of tracks connected to a motor;

a support connected to the arm of the vehicle, wherein the support is rotatable about a roll axis and a pitch axis with respect to the arm of the vehicle, wherein the support comprises an upper end and a lower end;

a hanger frame connected to the support, the hanger frame comprising a plurality of hanger receivers; and a plurality of hangers removably connected to the plurality of hanger receivers of the hanger frame, wherein the plurality of hangers are adapted to removably connect to a plurality of walls, wherein the support is adapted to retain each of the plurality of walls in a desired position and orientation with respect to the ground surface during installation of the plurality of walls in the ground surface.

13. The wall installation system of claim 12, comprising a brace connected to the lower end of the support.

14. The wall installation system of claim 12, wherein the plurality of walls comprises a first wall and a second wall, wherein the first wall is connected to the plurality of hangers at a first height, wherein the second wall is connected to the plurality of hangers at a second height, wherein the first height is lower than the second height.

15. The wall installation system of claim 12, wherein the support comprises a coupler, wherein the coupler of the support is removably connected to the arm of the vehicle.

16. The wall installation system of claim 15, wherein the coupler is pivotably connected to the arm by a pivot pin such that the support is rotatable about the roll axis with respect to the arm.

17. The wall installation system of claim 12, wherein each of the plurality of walls comprises a bollard wall including a plurality of slots, wherein each of the plurality of hangers is adapted to be removably connected within one of the plurality of slots.

18. A wall installation system, comprising:

a vehicle adapted to traverse a ground surface, wherein the vehicle includes:

an arm extending from the vehicle;

a plurality of wheels or a plurality of tracks connected to a motor;

a support connected to the arm of the vehicle, wherein the support is rotatable about at least one axis with respect to the arm of the vehicle, wherein the support comprises an upper end and a lower end;

wherein the support comprises a hanger frame;

wherein the support comprises a brace adapted to rest against a wall;

wherein the support comprises a coupler, wherein the coupler of the support is removably connected to the arm of the vehicle; and a plurality of hangers connected to the support, wherein the plurality of hangers are adapted to removably connect to the wall, wherein the support is adapted to retain the wall in a desired position and orientation with respect to the ground surface during installation of the wall in the ground surface.

19. The wall installation system of claim 18, wherein the plurality of hangers are removably connected to the support.

20. The wall installation system of claim 18, wherein the wall comprises a bollard wall including a plurality of vertical beams defining a plurality of slots.

21. The wall installation system of claim 20, wherein each of the plurality of hangers is connected within one of a plurality of slots of the wall.

22. The wall installation system of claim 18, wherein the support is rotatable about a roll axis with respect to the arm.

23. The wall installation system of claim 18, wherein the hanger frame comprises a plurality of hanger supports.

24. The wall installation system of claim 23, wherein each of the plurality of hangers is removably connected to one of the plurality of hanger supports of the hanger frame.

25. The wall installation system of claim 24, wherein each of the plurality of hanger supports of the hanger frame comprises a plurality of hanger receivers, each of the plurality of hanger receivers comprising an opening adapted to removably receive one of the plurality of hangers.

26. The wall installation system of claim 18, wherein the hanger frame is connected to the upper end of the support and wherein the brace is connected to the lower end of the support.

27. The wall installation system of claim 18, wherein the coupler comprises a first connector, wherein the first connector is pivotably connected to the arm.

28. The wall installation system of claim 27, wherein the coupler comprises a second connector, wherein the second connector is connected to the arm.

29. A wall installation system, comprising:

a vehicle adapted to traverse a ground surface, wherein the vehicle includes:

an arm extending from the vehicle;

a plurality of wheels or a plurality of tracks connected to a motor;

a support connected to the arm of the vehicle, wherein the support is rotatable about at least one axis with respect to the arm of the vehicle, wherein the support is rotatable about a roll axis with respect to the arm, wherein the support comprises an upper end and a lower end; and a plurality of hangers connected to the support, wherein the plurality of hangers are adapted to removably connect to a wall, wherein the support is adapted to retain the wall in a desired position and orientation with respect to the ground surface during installation of the wall in the ground surface, wherein the wall comprises a plurality of slots;

wherein the plurality of hangers are removably connected to the support, wherein each of the plurality of hangers is comprised of a horizontal portion, wherein the horizontal portion of each of the plurality of hangers is connected to the support, and wherein the horizontal portion of each of the plurality of hangers is adapted to extend through one of the plurality of slots of the wall.

30. The wall installation system of claim 29, wherein the wall comprises a bollard wall including a plurality of vertical beams defining the plurality of slots.

31. The wall installation system of claim 30, wherein each of the plurality of hangers is connected within one of the plurality of slots of the wall.

32. The wall installation system of claim 29, wherein the support comprises a hanger frame.

33. The wall installation system of claim 32, wherein the hanger frame comprises a plurality of hanger supports.

34. The wall installation system of claim 33, wherein each of the plurality of hangers is removably connected to one of the plurality of hanger supports of the hanger frame.

35. The wall installation system of claim 34, wherein each of the plurality of hanger supports of the hanger frame comprises a plurality of hanger receivers, each of the plurality of hanger receivers comprising an opening adapted to removably receive one of the plurality of hangers.

36. The wall installation system of claim 32, wherein the support comprises a brace adapted to rest against the wall.

37. The wall installation system of claim 36, wherein the hanger frame is connected to the upper end of the support and wherein the brace is connected to the lower end of the support.

38. The wall installation system of claim 36, wherein the support comprises a coupler, wherein the coupler of the support is removably connected to the arm of the vehicle.

39. The wall installation system of claim 38, wherein the coupler comprises a first connector, wherein the first connector is pivotably connected to the arm.

40. The wall installation system of claim 39, wherein the coupler comprises a second connector, wherein the second connector is connected to the arm.

41. A wall installation system, comprising:

a vehicle adapted to traverse a ground surface, wherein the vehicle includes:

an arm extending from the vehicle;

a plurality of wheels or a plurality of tracks connected to a motor;

a support connected to the arm of the vehicle, wherein the support is rotatable about at least one axis with respect to the arm of the vehicle, wherein the support comprises an upper end and a lower end; and a plurality of hangers connected to the support, wherein the plurality of hangers are adapted to removably connect to a wall, wherein the support is adapted to retain the wall in a desired position and orientation with respect to the ground surface during installation of the wall in the ground surface;

wherein the support comprises a hanger frame, wherein the hanger frame comprises a plurality of hanger supports, and wherein each of the plurality of hangers is removably connected to one of the plurality of hanger supports of the hanger frame.

42. The wall installation system of claim 41, wherein the wall comprises a bollard wall including a plurality of vertical beams defining a plurality of slots.

43. The wall installation system of claim 42, wherein each of the plurality of hangers is connected within one of the plurality of slots of the wall.

44. The wall installation system of claim 41, wherein the support is rotatable about a roll axis with respect to the arm.

45. The wall installation system of claim 41, wherein each of the plurality of hanger supports of the hanger frame comprises a plurality of hanger receivers, each of the plurality of hanger receivers comprising an opening adapted to removably receive one of the plurality of hangers.

46. The wall installation system of claim 41, wherein the support comprises a brace adapted to rest against the wall.

47. The wall installation system of claim 46, wherein the hanger frame is connected to the upper end of the support and wherein the brace is connected to the lower end of the support.

48. The wall installation system of claim 47, wherein the support comprises a coupler, wherein the coupler of the support is removably connected to the arm of the vehicle.

49. The wall installation system of claim 48, wherein the coupler comprises a first connector, wherein the first connector is pivotably connected to the arm.

50. The wall installation system of claim 49, wherein the coupler comprises a second connector, wherein the second connector is connected to the arm.

51. The wall installation system of claim 41, wherein the plurality of hangers are removably connected to the support.

52. A wall installation system, comprising:

a vehicle adapted to traverse a ground surface, wherein the vehicle includes:

an arm extending from the vehicle;

a plurality of wheels or a plurality of tracks connected to a motor;

a support connected to the arm of the vehicle, wherein the support is rotatable about at least one axis with respect to the arm of the vehicle, wherein the support comprises an upper end and a lower end; and a plurality of hangers connected to the support, wherein the plurality of hangers are adapted to removably connect to a bollard wall having a plurality of vertical beams and a plurality of slots, wherein the support is adapted to retain the bollard wall in a desired position and orientation with respect to the ground surface during installation of the bollard wall in the ground surface;

wherein each of the plurality of hangers includes a horizontal member extending outwardly from the support and a projection that extends upwardly from a distal portion of the horizontal member each of the plurality of hangers further includes a diagonal member extending between the support and the horizontal member, and wherein the horizontal member of each of the plurality of hangers is adapted to extend through one of the plurality of slots of the bollard wall.

53. A wall installation system, comprising:

a vehicle adapted to traverse a ground surface, wherein the vehicle includes:

an arm extending from the vehicle;

a plurality of wheels or a plurality of tracks connected to a motor;

a support connected to the arm of the vehicle, wherein the support is rotatable about at least one axis with respect to the arm of the vehicle, wherein the support comprises a hanger frame, and wherein the hanger frame comprises a plurality of hanger supports; and a plurality of hangers, wherein each of the plurality of hangers is removably connected to one of the plurality of hanger supports of the hanger frame, wherein the plurality of hangers are adapted to removably connect to a bollard wall having a plurality of vertical beams and a plurality of slots, wherein the support is adapted to retain the bollard wall in a desired position and orientation with respect to the ground surface during installation of the bollard wall in the ground surface.

54. A wall installation system, comprising:

a vehicle adapted to traverse a ground surface, wherein the vehicle includes:

an arm extending from the vehicle;

a plurality of wheels or a plurality of tracks connected to a motor;

a support connected to the arm of the vehicle, wherein the support is rotatable about at least one axis with respect to the arm of the vehicle, wherein the support comprises an upper end and a lower end, wherein the support comprises a hanger frame, and wherein the hanger frame comprises a plurality of hanger supports; and a plurality of hangers connected to the support, wherein the plurality of hangers are adapted to removably connect to a wall, wherein the support is adapted to retain the wall in a desired position and orientation with respect to the ground surface during installation of the wall in the ground surface;

wherein the plurality of hangers are removably connected to the support.

* * * * *